US007490918B2

(12) United States Patent
Nagashima

(10) Patent No.: US 7,490,918 B2
(45) Date of Patent: Feb. 17, 2009

(54) DROPLET DETERMINATION DEVICE AND DROPLET DETERMINATION METHOD FOR DROPLET DISCHARGE APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 204 days.

(21) Appl. No.: 11/071,447

(22) Filed: Mar. 4, 2005

(65) Prior Publication Data

US 2005/0253890 A1 Nov. 17, 2005

(30) Foreign Application Priority Data

Mar. 5, 2004 (JP) ..... 2004-062842

(51) Int. Cl.
*B41J 29/393* (2006.01)

(52) U.S. Cl. ..... 347/19; 347/8

(58) Field of Classification Search ..... 347/19, 347/8

See application file for complete search history.

(56) References Cited

U.S. PATENT DOCUMENTS

| | | | | |
|---|---|---|---|---|
| 5,276,459 | A | 1/1994 | Danzuka et al. | |
| 5,304,814 | A | 4/1994 | Markham | |
| 5,430,306 | A * | 7/1995 | Ix | 250/573 |
| 5,488,404 | A * | 1/1996 | Fleck et al. | 347/238 |
| 5,627,571 | A | 5/1997 | Anderson et al. | |
| 6,322,190 | B1 | 11/2001 | Kono et al. | |
| 2002/0180824 | A1 | 12/2002 | Endo | |
| 2003/0103131 | A1 * | 6/2003 | Arakawa | 347/106 |
| 2003/0132981 | A1 | 7/2003 | Arakawa et al. | |
| 2003/0193557 | A1 * | 10/2003 | Ornellas et al. | 347/243 |
| 2004/0011975 | A1 * | 1/2004 | Nicoli et al. | 250/574 |
| 2004/0119779 | A1 * | 6/2004 | Elgee | 347/40 |

FOREIGN PATENT DOCUMENTS

| | | | |
|---|---|---|---|
| EP | 1 027 987 | A1 | 8/2000 |
| JP | 4-72869 | A | 3/1992 |
| JP | 6-270414 | A | 9/1994 |
| JP | 8-118679 | A | 5/1996 |
| JP | 8-309964 | A | 11/1996 |

(Continued)

*Primary Examiner*—Manish S Shah
*Assistant Examiner*—Laura E Martin
(74) *Attorney, Agent, or Firm*—Birch, Stewart, Kolasch & Birch, LLP

(57) ABSTRACT

The droplet determination device for a droplet discharge apparatus, includes a droplet discharge device having droplet discharge ports which discharge liquid droplets; a detection device in which a light source and a light sensor are disposed in such a manner that an optical axis of a light beam formed between the light source and the light sensor is substantially perpendicular to a direction of flight of the droplets discharged from the droplet discharge ports, and the optical axis of the light beam is substantially parallel to a droplet discharge port surface in which the droplet discharge ports are arranged; an optical system which forms the light beam into substantially parallel light, when the optical axis is viewed from a direction perpendicular to the optical axis, of which a cross-sectional shape in the direction perpendicular to the optical axis of the light beam is elongated in the direction of flight of the droplets; and a discharge judgment device which judges a discharge status of the droplet according to a detection signal obtained from the detection device when the droplet is discharged into the light beam.

25 Claims, 13 Drawing Sheets

FOREIGN PATENT DOCUMENTS

| | | | |
|---|---|---|---|
| JP | 9-94947 | A | 4/1997 |
| JP | 9-94948 | A | 4/1997 |
| JP | 9-94959 | A | 4/1997 |
| JP | 2000-146993 | A | 5/2000 |
| JP | 2000-233520 | A | 8/2000 |
| JP | 2000-272134 | A | 10/2000 |
| JP | 2001-113681 | A | 4/2001 |
| JP | 2001-150696 | A | 6/2001 |
| JP | 2002-355984 | A | 12/2002 |
| JP | 2003-118133 | A | 4/2003 |
| JP | 2003-121452 | A | 4/2003 |
| JP | 2003-127430 | A | 5/2003 |
| JP | 2003-191463 | A | 7/2003 |
| JP | 2003-225996 | A | 8/2003 |
| JP | 2004-66782 | A | 3/2004 |
| WO | WO-03/055687 | A1 | 7/2003 |

* cited by examiner

DROPLET DETERMINATION DEVICE AND DROPLET DETERMINATION METHOD FOR DROPLET DISCHARGE APPARATUS

BACKGROUND OF THE INVENTION

1. Field of the Invention

The present invention relates to a droplet determination device and a droplet determination method for a droplet discharge apparatus, and more particularly, to a droplet determination device and droplet determination method for determining the discharge of droplets in a droplet discharge apparatus which performs image recording by discharging droplets of ink, or the like, onto a recording medium.

2. Description of the Related Art

Conventionally, an image forming apparatus (inkjet printer) is known, which comprises an inkjet head (ink discharge head) having an arrangement of a plurality of nozzles (ink discharge ports) and which forms images on a recording medium by discharging ink (ink droplets) from the nozzles while causing the inkjet head and the recording medium to move relatively to each other.

Various methods are known conventionally as ink discharge methods for an inkjet recording apparatus of this kind. For example, one known method is a piezoelectric method, where the volume of a pressure chamber (ink chamber) is changed by causing a vibration plate forming a portion of the pressure chamber to deform due to deformation of a piezoelectric element (piezoelectric actuator), ink being introduced into the pressure chamber from an ink supply passage when the volume is increased, and the ink inside the pressure chamber being discharged as a droplet from the nozzle when the volume of the pressure chamber is reduced. Another known method is a thermal inkjet method where ink is heated to generate a bubble in the ink, and ink is then discharged by means of the expansive energy created as the bubble grows.

In an image forming apparatus having an ink discharge head such as an inkjet recording apparatus, ink is supplied to an ink discharge head via an ink supply channel from an ink tank which stores ink, and this ink is discharged by one of the various discharge methods described above. However, it is necessary that ink is discharged stably in such a manner that factors such as the ink discharge volume, the discharge velocity, the discharge direction, and the three-dimensional shape of the discharged ink, conform to prescribed values at all times.

However, during printing, ink is filled into the nozzles of the ink discharge head at all times, in order that printing can be carried out immediately upon receiving a print instruction. Since the ink inside the nozzles is exposed to the air, ink inside the nozzles which have not discharged ink for a long period of time proceeds to dry, the viscosity of the ink increases, and the nozzles may become blocked up. Furthermore, if air bubbles become trapped inside the ink supply channels, or the like, of if the ink supply is interrupted or discharge continues for a long period of time, then ink refilling slows down, the ink meniscus at the nozzle section retreats, and eventually, air bubbles may be sucked into the head due to the negative pressure on the ink supply side.

Due to reasons such as these, it is necessary to perform maintenance of the discharge head when ink is no longer being discharged in a stable fashion as described above. Therefore, conventionally, various methods have been proposed in order to determine whether or not ink is being discharged stably.

For example, a method is known in which a light source including an infrared LED array having a peak wavelength in the infrared region is disposed at one end of the front face of the discharge port surface (the nozzle surface), an infrared CCD sensor having a peak wavelength in the infrared region is disposed at the other end thereof, and a dummy discharge is performed toward an ink receptacle after each certain number of scans, the transmitted light being recorded by the light source and sensor, and the positions of discharge failures being determined on the basis of the density data thus recorded (see, for example, Japanese Patent Application Publication No. 06-270414).

Furthermore, a method is known in which the emission of small droplets and the direction of these droplets is checked one at a time for each of the nozzles of a nozzle array in a full-width array print head, by means of a droplet sensor including an infrared light-emitting diode (LED) and a sensing region formed by a single laterally placed photodiode (see, for example, Japanese Patent Application Publication No. 08-118679).

Moreover, a method is known in which the output of a sensor that detects the presence of ink droplets emitted from an inkjet head is integrated by an integrator, the integrated signal is amplified by a high-gain amplifier, thereby generating a sensor circuit output signal, and the emission of ink droplets is determined on the basis of this integrated output signal, which indicates the presence of a droplet when a droplet at least partially interrupts the light path (see, for example, U.S. Pat. No. 5,304,814).

Furthermore, a device is also known in which an infrared LED is used as a light-emitting element of a photosensor, a lens being formed integrally with the light emitting surface of the LED in such a manner that substantially parallel light is transmitted, and a phototransistor is used as a light-receiving element of the photosensor, the light-receiving surface of the light-receiving element being formed with a hole of 0.7 mm width and height by means of a molded member, thereby restricting the detection range, reducing the number of droplets that are detected simultaneously and hence increasing the detection resolution (see, for example, Japanese Patent Application Publication No. 08-309964). A device is known which has a similar composition, wherein the detection range is restricted to 2 mm in the height direction and 0.5 mm in the width direction, through the whole region between the light-receiving element and the light-emitting element, in such a manner that the detection width can be changed in the vertical and horizontal directions (see, for example, Japanese Patent Application Publication No. 09-94947).

Furthermore, a method is also known in which a light-emitting element and a light-receiving element of a photosensor for detecting ink discharge are positioned in such a manner that the optical axis of detection determined by these elements forms a prescribed angle with respect to the direction in which ink discharge ports are arranged in a recording head. Consequently, the detection region of the photosensor is increased (see, for example, Japanese Patent Application Publication No. 09-94948).

Moreover, a method is also known in which a light-emitting element and a light-receiving element for detecting ink discharged by an inkjet head are provided at a prescribed position within the range of movement of the inkjet head. If the amount of light arriving at the light-receiving element is reduced by the presence of an ink droplet discharge by the inkjet head, then a change in the current corresponding to this light reduction is amplified by a change amplifying unit, and the ink discharge amount is judged on the basis of a pulse signal which compares the amplified signal with a prescribed voltage (see, for example, Japanese Patent Application Publication No. 09-94959).

Furthermore, a device for inspecting missing dots by investigating whether or not an ink droplet passes between a light-emitting element and a light-receiving element is also known, in which the light emitting element is a laser that emits a light beam having an external diameter of approximate 1 mm or less, and the emitted laser light is shaped into a laser light beam of a prescribed thickness by cutting out the low-intensity fringe portions of the beam by means of a slit, in order to facilitate measurement of the flight velocity of the ink droplets, (namely, the light is shaped into a flat parallel light beam in which the top and bottom sides are cut off in a straight line). By measuring the time taken by the ink droplet to travel through the thickness of the laser light beam, it is possible to identify the flight velocity of the ink droplets (see, for example, Japanese Patent Application Publication No. 2000-272134).

A method is also known in which a light beam emitted by a light emitting element is directed toward a light-receiving element via a slit opening, and the slit is rotated to an angle corresponding to the size of a discharge ink droplet by automatically rotating the slit with respect to the light beam. By effectively changing the size of the slit opening in this way (in other words, changing the aperture width), an optimum light reception intensity is achieved in accordance with the size of the ink droplet, and therefore the state of ink discharge can be determined with good accuracy (see, for example, Japanese Patent Application Publication No. 2001-113681).

A method is also known in which a device for determining discharge characteristics data relating to ink droplets determines the presence or absence of discharge by detecting whether or not an ink droplet has interrupted light, and determines the volume of the ink droplet by measuring the amount of light interrupted by the ink droplet. Two parallel light beams are output from a light source, and the discharge velocity of the ink droplet is determined by measuring the time taken for the ink droplet to travel between these two light beams (see, for example, Japanese Patent Application Publication No. 2003-127430).

However, in the device described in Japanese Patent Application Publication No. 06-270414, the sensing device for determining the discharge state of the discharge ports, in other words, the sensor which records the transmitted light image does not comprise a single element, but rather, a plurality of pixels arranged in a line, as in a CCD. This is not sufficient in terms of improving determination sensitivity. Furthermore, the method described in Japanese Patent Application Publication No. 08-118679 actually detects droplets by means of a sensor formed by a single LED and photodiode, but it checks the nozzles one at a time and is not satisfactory in terms of achieving efficient inspection of a plurality of nozzles, or improving inspection sensitivity.

Furthermore, the methods and devices described in U.S. Pat. No. 5,304,814, Japanese Patent Application Publication No. 08-309964 and Japanese Patent Application Publication No. 09-94947 seek to improve determination sensitivity by means of a signal processing method, or by restricting the beam used for detection so as to reduce the number of ink droplets detected simultaneously, but they are not satisfactory in terms of improving determination sensitivity with respect to a head having a very large number of nozzles, such as a page-wide head which corresponds the full width of the recording medium, for example.

The method described in Japanese Patent Application Publication No. 09-94948 is a method for inspecting an entire inkjet head in a shuttle scanning system, by means of a fixed determination system, but this method is not effective for fixed, long heads, such as a single-pass page-wide head that is capable of recording onto the entire width of the recording medium in a single action, without shuttle scanning.

Furthermore, the method described in Japanese Patent Application Publication No. 09-94959 determines the ink discharge volume, but it is not able to determine the ink discharge velocity. If this method is combined with the method described in Japanese Patent Application Publication No. 2000-272134, then both the ink discharge volume and the ink discharge velocity can be determined, but since no compensatory method is provided for use in the case of differences in the ink droplet size, then it will not be possible to determine ink discharge velocity if the ink droplet size varies.

Furthermore, the method described in Japanese Patent Application Publication No. 2001-113681 changes the beam width, but the purpose of this is to stabilize the determination process by altering the light intensity, and it does not involve a significant change in determination characteristics. Furthermore, the method described in Japanese Patent Application Publication No. 2003-127430 requires two light beams in order to determine the ink discharge velocity, and hence the composition is complicated.

SUMMARY OF THE INVENTION

The present invention has been contrived in view of these circumstances, and an object thereof is to provide a droplet determination device and a droplet determination method for a droplet discharge apparatus whereby droplet discharge can be determined with good efficiency and a high degree of sensitivity, even in the case of small droplets of ink, or the like, in a long head having a very large number of nozzles, such as a page-wide head corresponding to the entire width of a recording medium, for example, while also being able to determine the droplet volume (droplet size) and the droplet discharge velocity, as well as determining whether or not droplets are being discharged in a stable state.

In order to attain the aforementioned object, the present invention is directed to a droplet determination device for a droplet discharge apparatus, comprising: a droplet discharge device having droplet discharge ports which discharge liquid droplets; a detection device in which a light source and a light sensor are disposed in such a manner that an optical axis of a light beam formed between the light source and the light sensor is substantially perpendicular to a direction of flight of the droplets discharged from the droplet discharge ports, and the optical axis of the light beam is substantially parallel to a droplet discharge port surface in which the droplet discharge ports are arranged; an optical system which forms the light beam into substantially parallel light, when the optical axis is viewed from a direction perpendicular to the optical axis, of which a cross-sectional shape in the direction perpendicular to the optical axis of the light beam is elongated in the direction of flight of the droplets; and a discharge judgment device which judges a discharge status of the droplet according to a detection signal obtained from the detection device when the droplet is discharged into the light beam.

According to the present invention, since the light beam used to detect the droplets is a parallel light beam, it is possible to achieve uniform determination conditions for the droplets, independently of the position of the droplet discharge ports (nozzles) under inspection, namely, regardless of whether the nozzles are situated near the light source or near the light sensor, even in cases where the droplet discharge device is a long head. Furthermore, by making the light beam have a cross-sectional shape perpendicular to its optical axis that is elongated in the direction of flight of the discharged ink droplets, it is possible to capture the whole of a long, thin column-shaped droplet formed immediately after discharge, within the light beam. Therefore, determination sensitivity can be improved.

Furthermore, in order to attain the aforementioned object, the present invention is also directed to droplet determination device for a droplet discharge apparatus, comprising: a droplet discharge device having droplet discharge ports which discharge liquid droplets; a detection device in which a light source and a light sensor are disposed in such a manner that an optical axis of a light beam formed between the light source and the light sensor is substantially perpendicular to a direction of flight of the droplets discharged from the droplet discharge ports, and the optical axis of the light beam is substantially parallel to a droplet discharge port surface in which the droplet discharge ports are arranged; an optical system which forms the light beam into substantially parallel light, when the optical axis is viewed from a direction perpendicular to the optical axis, of which a cross-sectional shape in the direction perpendicular to the optical axis of the light beam is elongated in a breadthways direction of the droplet discharge port surface, which is perpendicular to a lengthwise direction of the droplet discharge port surface, in such a manner that the light beam is capable of containing droplets discharged from the discharge ports arranged in the breadthways direction; and a discharge judgment device which judges a discharge status of the droplet according to a detection signal obtained from the detection device when the droplet is discharged into the light beam.

According to the present invention, even if the direction of flight of the droplets and the position of the light beam are slightly displaced, then droplet determination is still possible, and furthermore, a plurality of droplets can be discharged so as to pass simultaneously through the light beam and hence a plurality of droplets from a certain group of nozzles can be detected simultaneously.

Preferably, the detection device detects droplets which are discharged from the droplet discharge ports into the light beam, in a region of up to 0.5 mm from the droplet discharge ports. According to this, by detecting ink droplets in a region close to the droplet discharge ports, namely, up to 0.5 mm from the droplet discharge ports, it is possible to capture a discharged droplet while it still forms a column shape and before it forms into a round sphere. Therefore, the cross-sectional area of the droplet in flight increases with respect to the light beam, and hence a larger detection signal can be obtained.

Preferably, the droplet determination device further comprises a modification device which modifies the cross-sectional shape of the light beam in the direction perpendicular to the optical axis thereof, so as to alter at least a width of the light beam. According to this, it is possible to change the number of droplets which are detected simultaneously.

Preferably, the droplet determination device further comprises a scanning device which makes the light beam traverse with respect to the droplets discharged from the droplet discharge device, in order to detect the droplets. Moreover, preferably, the scanning device makes the light beam traverse so as to determine a position corresponding to a certain range of the droplet discharge ports of the droplet discharge device. By making the light beam traverse in this way, it is possible to detect droplets in a position corresponding to a plurality of droplet discharge ports within a certain range.

Preferably, the scanning device makes the light beam traverse in parallel with the droplet discharge port surface, while keeping the light beam substantially parallel with one of the lengthwise direction of the droplet discharge port surface and the breadthways direction of the droplet discharge port surface which is perpendicular to the lengthwise direction. Moreover, preferably, the scanning device makes the light beam traverse in a plane that is perpendicular to the direction of flight of the droplets discharged from the droplet discharge device. Thereby, the entire surface of the droplet discharge device containing the droplet discharge ports can be scanned, and hence the discharge status can be determined in respect of all of the droplet discharge ports.

Preferably, the light beam is a substantially parallel light beam when the optical axis thereof is viewed from the direction of flight of the droplets, and is one of a converging light beam and a diverging light beam when viewed from the breadthways direction of the droplet discharge port surface. According to this, in the cross-section of the light beam perpendicular to the optical axis, the light beam is parallel light in the direction perpendicular to the direction of flight of the droplets in such a manner that it does not overlap with adjacent droplet discharge ports, and in the direction of flight of the droplets, it never interferes with a droplet discharged from another droplet discharge port. Hence, the light beam may deviate from the parallel direction and efficient droplet determination can be achieved.

Preferably, the droplet determination device further comprises a discharge timing control device which controls droplet discharge of the droplet discharge device in such a manner that, when the droplet discharge device discharges a plurality of droplets into the light beam, discharge timings for the droplets are respectively staggered. According to this, it is possible to detect a plurality of droplets simultaneously.

Preferably, the droplet determination device further comprises a droplet velocity calculating device which calculates a velocity V m/sec of the discharged droplet by means of the following equation: $V=(W+D)\times10^{-6}/\Delta t+\epsilon(W, D)$, where a size of the droplet as determined from an amount of fall in the detection signal obtained from the detection device due to the droplet transiting the light beam is taken to be D μm, a width of the light beam in the direction of flight of the droplet is taken to be W μm, a duration of the fall in the detection signal is taken to be Δt sec, and a prescribed error correction value determined with respect to the width of the light beam W and the droplet size D is taken to be $\epsilon(W, D)$ m/sec. According to this, it is possible to determine the flight velocity of the discharged droplets.

Preferably, the light source of the detection device is any one of: a laser diode, a solid laser, a gas laser, a light-emitting diode, an electro luminescence device, a xenon lamp, a metal halide lamp, a cold cathode fluorescent tube, a hot cathode fluorescent tube, and a halogen lamp.

In order to attain the aforementioned object, the present invention is also directed to a droplet determination method for determining droplets discharged by a droplet discharge apparatus, comprising the steps of: forming a light beam between a light source and a light sensor, an optical axis of the light beam being substantially parallel to a lengthwise direction of a droplet discharge port surface of the droplet discharge apparatus in which droplet discharge ports are arranged, the light beam being a substantially parallel light beam when the optical axis is viewed from at least one direction in a plane perpendicular to the light beam, and being formed with a cross-sectional shape perpendicular to the optical axis that is elongated in a direction of flight of the discharged droplets; and judging a discharge status of a droplet according to a detection signal obtained by the light sensor when the droplet is discharged into the light beam in such a manner that the direction of flight of the droplet is substantially perpendicular to the optical axis of the light beam.

According to the present invention, it is possible to ensure uniform determination conditions for droplets, regardless of the position of the corresponding droplet discharge ports, even if the droplet discharge device is a long head. Furthermore, by making the light beam have a cross-sectional shape perpendicular to its optical axis that is elongated in the direction of flight of the discharged ink droplets, it is possible to contain the whole of a long, thin column-shaped droplet formed immediately after discharge, within the light beam. Therefore, determination sensitivity can be improved.

In order to attain the aforementioned object, the present invention is also directed to a droplet determination method for determining droplets discharged by a droplet discharge apparatus, comprising the steps of: forming a light beam between a light source and a light sensor, an optical axis of the light beam being substantially parallel to a lengthwise direction of a droplet discharge port surface of the droplet discharge apparatus in which droplet discharge ports are arranged, the light beam being a substantially parallel light beam when the optical axis is viewed from at least one direction in a plane perpendicular to the light beam, and being formed with a cross-sectional shape perpendicular to the optical axis that is elongated in a breadthways direction of the droplet discharge port surface which is perpendicular to a lengthwise direction of the droplet discharge port surface, in such a manner that the light beam is capable of containing droplets discharged from the droplet discharge ports arranged in the breadthways direction; and judging a discharge status of the droplet according to a detection signal obtained by the light sensor when the droplet is discharged into the light beam in such a manner that a direction of flight of the droplet is substantially perpendicular to the optical axis of the light beam.

According to the present invention, even if the direction of flight of the droplets and the position of the light beam are slightly displaced, then droplet determination is still possible, and furthermore, a plurality of droplets can be discharged so as to pass simultaneously through the light beam and hence a plurality of droplets in a certain state can be detected simultaneously.

In order to attain the aforementioned object, the present invention is also directed to a droplet determination method for determining droplets discharged by a droplet discharge apparatus, comprising the steps of: forming a light beam between a light source and a light sensor, an optical axis of the light beam being substantially parallel to a lengthwise direction of a droplet discharge port surface of the droplet discharge apparatus in which droplet discharge ports are arranged, the light beam being a substantially parallel light beam when the optical axis is viewed from at least one direction in a plane perpendicular to the light beam, and being formed with a cross-sectional shape perpendicular to the optical axis that is elongated in a breadthways direction of the droplet discharge port surface which is perpendicular to a lengthwise direction of the droplet discharge port surface, in such a manner that the light beam is capable of containing droplets discharged from the droplet discharge ports arranged in the breadthways direction; detecting a plurality of droplets simultaneously according to detection signals obtained by the light sensor when droplets are discharged into the light beam in such a manner that a direction of flight of the droplets is substantially perpendicular to the optical axis of the light beam; if there is a droplet discharge port with possibility of discharge failure, forming a light beam between a light source and a light sensor, the optical axis of the light beam being substantially parallel to the lengthwise direction of the droplet discharge port surface, the light beam being a substantially parallel light beam when the optical axis is viewed from at least one direction of the plane perpendicular to the light beam, and being formed with a cross-sectional shape perpendicular to the optical axis that is elongated in the direction of flight of the discharged droplets; and judging a discharge status of droplets according to a detection signal obtained by the light sensor when the droplets are discharged into the light beam in such a manner that the direction of flight of the droplets is substantially perpendicular to the optical axis of the light beam.

According to the present invention, it is possible accurately to determine a droplet discharge port suffering an abnormality.

As described above, according to the droplet determination device and the droplet determination method for a droplet discharge apparatus relating to the present invention, it is possible to detect a plurality of droplets, simultaneously and efficiently, even in a droplet discharge device such as a long head having a large number of droplet discharge ports. Furthermore, droplets can be determined with high sensitivity, even if the droplets of ink, or the like, are small, and moreover, the droplet volume (droplet size) and droplet discharge velocity can be determined, as well as determining whether or not droplets have been discharged in stable discharge conditions.

Furthermore, if, in addition to making it possible to alter the shape of the light beam, such as the width thereof, the light beam is also made to traverse, then it becomes possible to switch between efficient simultaneous determination of a plurality of droplets, and accurate determination for verifying determination results. Furthermore, if the droplet discharge device is a matrix head, for example, then it is possible to inspect droplet discharge in the whole droplet discharge device, by means of a single determination unit.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 11A and 11B are schematic drawings showing a first example of the basic composition of an optical system for converting parallel light into parallel light of a different width, wherein FIG. 11A is a plan view and FIG. 11B is a front view;

FIGS. 12A and 12B are schematic drawings showing a second example of the basic composition of an optical system for converting parallel light into parallel light of a different width, wherein FIG. 12A is a plan view and FIG. 12B is a front view;

FIGS. 13A and 13B are schematic drawings showing a third example of the basic composition of an optical system for converting parallel light into parallel light of a different width, wherein FIG. 13A is a plan view and FIG. 13B is a front view;

FIGS. 14A and 14B are schematic drawings showing a fourth example of the basic composition of an optical system for converting parallel light into parallel light of a different width, wherein FIG. 14A is a plan view and FIG. 14B is a front view;

FIGS. 15A and 15B are schematic drawings showing a first example of an optical system for altering the width of parallel light, wherein FIG. 15A is a plan view and FIG. 15B is a front view;

FIGS. 16A and 16B are schematic drawings showing a second example of an optical system for altering the width of parallel light, wherein FIG. 16A is a plan view and FIG. 16B is a front view;

FIGS. 17A and 17B are schematic drawings showing a third example of an optical system for altering the width of parallel light, wherein FIG. 17A is a plan view and FIG. 17B is a front view;

FIGS. 21A and 21B are illustrative diagrams showing an example in which the parallel light is made to traverse in a fan shape, wherein FIG. 21A is a plan view and FIG. 21B is an oblique view as seen from the under side;

DETAILED DESCRIPTION OF THE PREFERRED EMBODIMENTS

A droplet discharge apparatus applied to the droplet determination device and the droplet determination method of the present invention is explained. A present embodiment is explained by an inkjet recording apparatus as an example of the droplet discharge apparatus. The inkjet recording apparatus is an apparatus for recording image and the like, by discharging each ink as droplet from nozzles as ink-droplet ejection apertures onto a recording medium.

Figure 1:
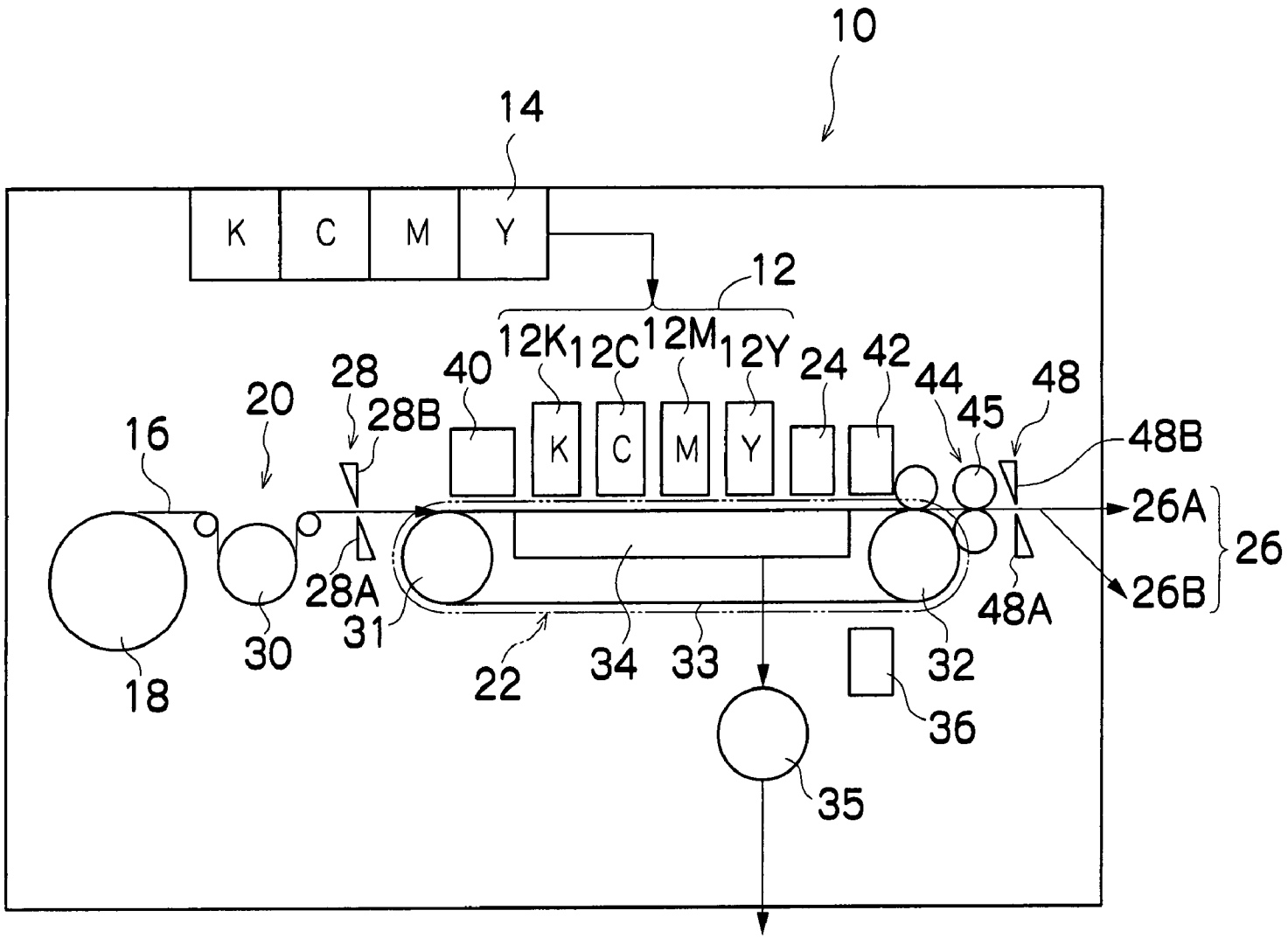
FIG. 1 is a general schematic drawing of an inkjet recording apparatus according to an embodiment of the present invention.

FIG. 1 is a general schematic drawing of the inkjet recording apparatus according to an embodiment such as the droplet discharge apparatus.

As shown in FIG. 1, the inkjet recording apparatus 10 comprises: a printing unit 12 having a plurality of droplet discharge heads or print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 comprises the print heads units 12K, 12C, 12M, and 12Y corresponding to four ink-colors (KCMY). Each of the print head units 12K, 12C, 12M, and 12Y forms a so-called full-line head in which a line head is configured by arranging long side of a plurality of discharge heads including a plurality of ejection apertures to a length that corresponds to the maximum paper width and is disposed in perpendicular direction to the delivering direction of the recording paper 16 (hereinafter, referred to as the paper conveyance direction). A specific structural example is described following, each of the print head units 12K, 12C, 12M, and 12Y is equipped with various devices for determining an ink-discharging condition, the size of discharged ink-droplet, the speed of discharged ink, and the like (for example, a detection device for determining the discharged ink, an optical system for forming the predefined shape of luminous flux for determining, and the like).

Figure 2:
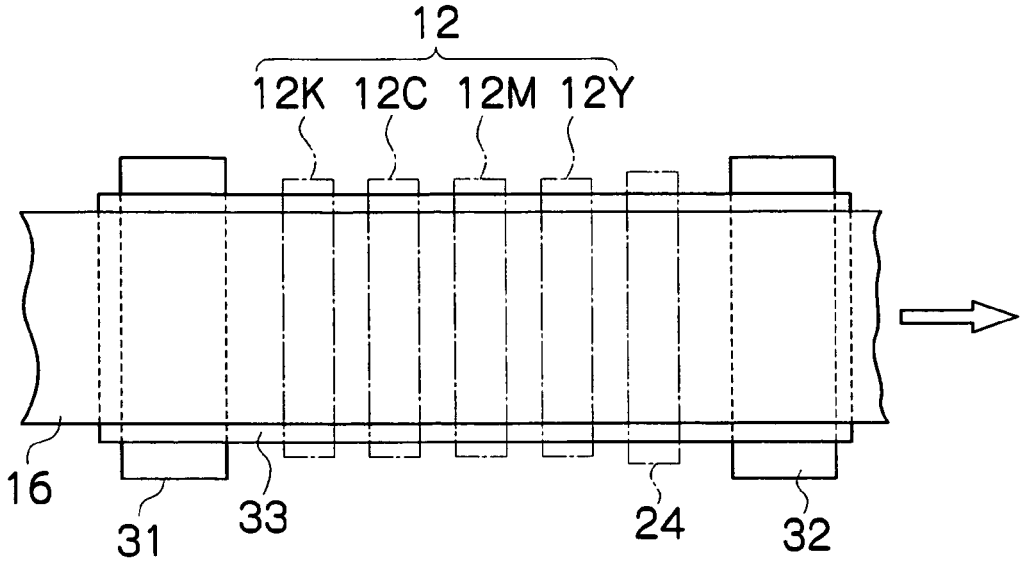
FIG. 2 is a plan view of principal components of an area around a printing unit of the inkjet recording apparatus in FIG. 1.

As shown FIG. 2, each of the print head units 12K, 12C, 12M, and 12Y is composed of a line head in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side (the left-hand side in FIG. 1) along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator, or the like) for warning when the remaining amount of any ink is low, and has a mechanism for preventing loading errors among the colors.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the droplet discharge heads or the print head units is described. The print head units 12K, 12C, 12M, and 12Y provided for the respective ink colors have the same structure, and a reference numeral 50 is hereinafter designated to any of the print head units 12K, 12C, 12M, and 12Y.

Figure 3:
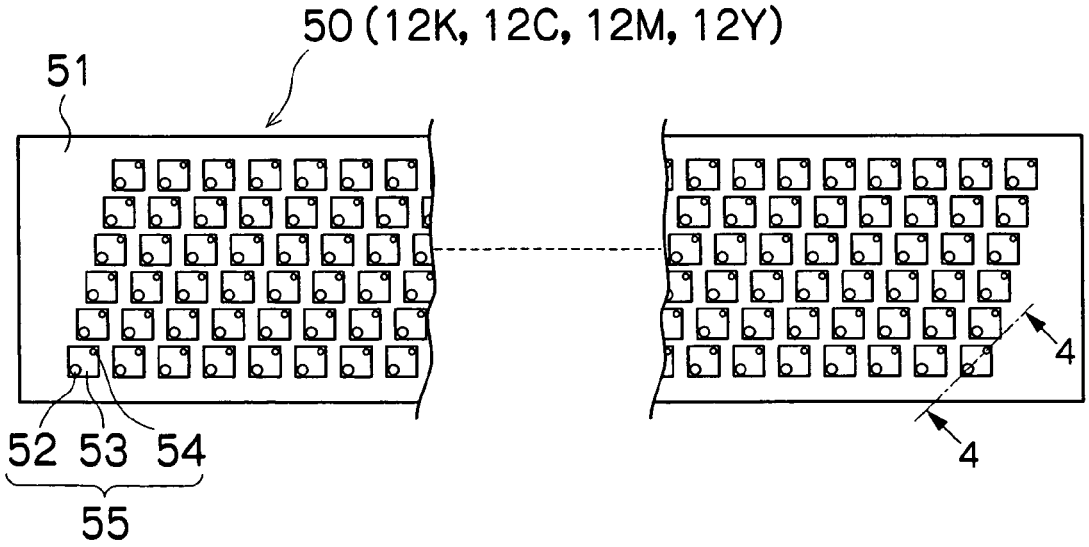
FIG. 3 is a perspective plan view showing an example of a configuration of a print head.

The print head unit 50 is provided with a print head 51 as a discharge device for discharging the ink. FIG. 3 is a perspective plan view showing an example of the configuration of the print head 51.

The nozzle pitch in the print head 51 should be minimized in order to maximize the density of the dots printed on the surface of the recording paper. As shown in FIG. 3, the print head 51 in the present embodiment has a structure in which a plurality of ink chamber 53 including nozzles 52 for ejecting ink-droplets and pressure chambers 53 connecting to the nozzles 52 are disposed in the form of a staggered matrix, and the effective nozzle pitch is thereby made small.

The planar shape of the pressure chamber 53 provided for each nozzle 52 is substantially a square, and the nozzle 52 and supply port 54 are disposed in both corners on a diagonal line of the square. Each pressure chamber 53 is connected to a common channel (not shown) through a supply port 54. Ink is delivered from the common flow channel through the supply port 54 to the pressure chamber 53, and is ejected from the nozzle 52 onto the recording paper 16 due to deforming the pressure chamber 53 by the pressure from an actuator, or the like (not shown).

Figure 4:
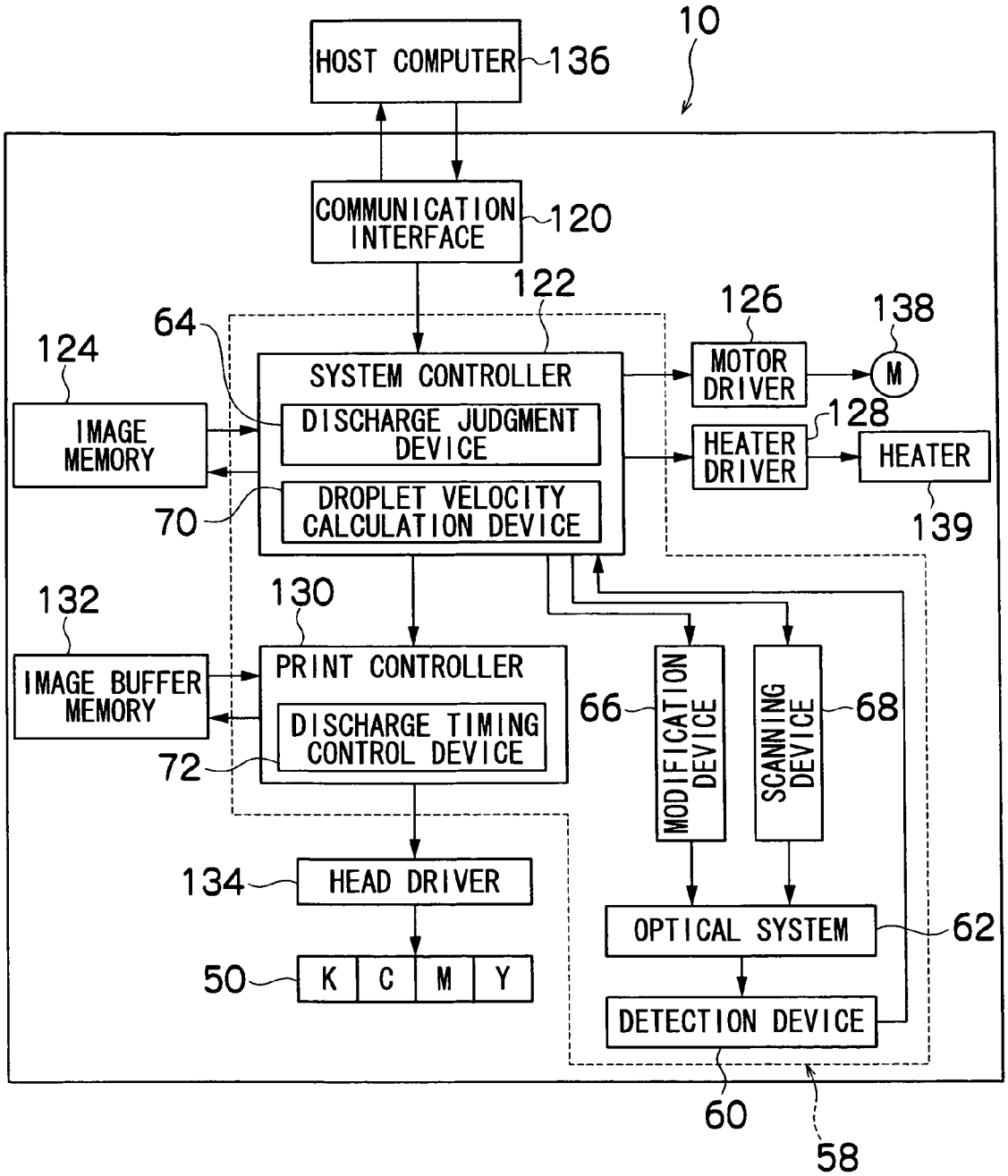
FIG. 4 is a principal block diagram showing the system composition of the inkjet recording apparatus.

FIG. 4 is a block diagram of the principal components showing the system configuration of the inkjet recording apparatus 10. The inkjet recording apparatus 10 has a communication interface 120, a system controller 122, an image memory 124, a motor driver 126, a heater driver 128, a print controller 130, an image buffer memory 132, a head driver 134, and other components.

The communication interface 120 is an interface unit for receiving image data sent from a host computer 86. A serial interface such as USB, IEEE1394, Ethernet, wireless network, or a parallel interface such as a Centronics interface may be used as the communication interface 120. A buffer memory (not shown) may be mounted in this portion in order to increase the communication speed.

The image data sent from the host computer 86 is received by the inkjet recording apparatus 10 through the communication interface 120, and is temporarily stored in the image memory 124. The image memory 124 is a storage device for temporarily storing images inputted through the communication interface 120, and data is written and read to and from the image memory 124 through the system controller 122. The image memory 124 is not limited to memory composed of a semiconductor element, and a hard disk drive or another magnetic medium may be used.

The system controller 122 controls the communication interface 120, image memory 124, motor driver 126, heater driver 128, and other components. The system controller 122 has a central processing unit (CPU), peripheral circuits therefor, and the like. The system controller 122 controls communication between itself and the host computer 86, controls reading and writing from and to the image memory 124, and performs other functions, and also generates control signals for controlling a heater 139 in the post-drying unit 42 (referred to FIG. 1), and the like.

The print controller 130 has a signal processing function for performing various tasks, compensations, and other types of processing for generating print control signals from the image data stored in the image memory 124 in accordance with commands from the system controller 122 so as to apply the generated print control signals (image formation data) to the head driver 134.

The print control unit 130 is a control unit having a signal processing function for performing various treatment processes, corrections, and the like, in accordance with the control implemented by the system controller 122, in order to generate a signal for controlling printing, from the image data in the image memory 124, and it supplies the print control signal (image data) thus generated to the head driver 134. Prescribed signal processing is carried out in the print control unit 130, and the discharge amount and the discharge timing of the ink droplets or the protective liquid from the respective print heads 50 are controlled via the head drier 134, on the basis of the image data. By this means, prescribed dot size, dot positions, or coating of protective liquid can be achieved.

Figure 7:
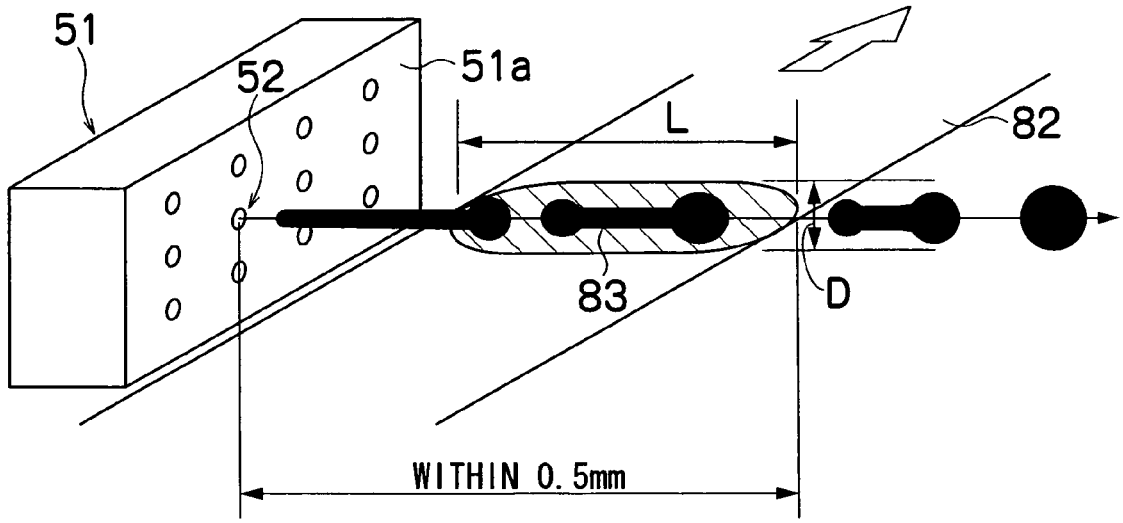
FIG. 7 is an illustrative diagram showing parallel light having a cross-sectional shape perpendicular to the optical axis that is long and thin in the direction of flight of the ink droplets.

The print controller 130 is provided with the image buffer memory 132; and image data, parameters, and other data are temporarily stored in the image buffer memory 132 when image data is processed in the print controller 130. The aspect shown in FIG. 7 is one in which the image buffer memory 132 accompanies the print controller 130; however, the image memory 124 may also serve as the image buffer memory 132. Also possible is an aspect in which the print controller 130 and the system controller 122 are integrated to form a single processor.

The head driver 134 drives the actuators 59 for the print heads 12K, 12C, 12M and 12Y of the respective colors on the basis of the print data received from the print controller 130. A feedback control system for keeping the drive conditions for the print heads constant may be included in the head driver 134.

Furthermore, the inkjet recording apparatus 10 according to the present embodiment also comprises a droplet determination device 58 for determining the status of ink discharge from the print head 50.

The droplet determination device 58 comprises a detection device 60 for detecting ink that has been discharged from the print head 50 and is in flight in the air, by means of determination light, an optical system 62 and a modification device 66 for controlling the determination light, a scanning device 68, a discharge judgment device 64 for judging the discharge status of the ink, a droplet velocity calculation device 70 for calculating the velocity of flight of the discharged ink, and a discharge timing control device 72 for controlling discharge in such a manner that, when a plurality of ink droplets are to be discharged simultaneously, their discharge timings are staggered respectively.

Each section of the droplet determination device 58 is described in detail below, but the actions of the discharge judgment device 64 and the droplet velocity calculation device 70 are implemented by the system controller 122, and the actions of the discharge timing control device 72 are implemented by the print controller 130.

As described hereinafter, the discharge judgment device 64 judges the ink discharge status by receiving a detection signal from the detection device 60, and a corresponding judgment program is stored in the memory of the system controller 122. When a detection signal is received, the judgment program is called up and a judgment calculation is executed by the CPU of the system controller 122. Similarly, with respect to the droplet velocity calculation device 70, a velocity calculating program is stored in the memory of the system controller 122 and the actual velocity calculation procedure is executed by the CPU of the system controller 122 upon receiving prescribed data from the discharge judgment device 64.

Furthermore, the discharge timing control device 72 is realized by means of the print controller 130 controlling the discharge timing under the control of the system controller 122.

Figure 5:
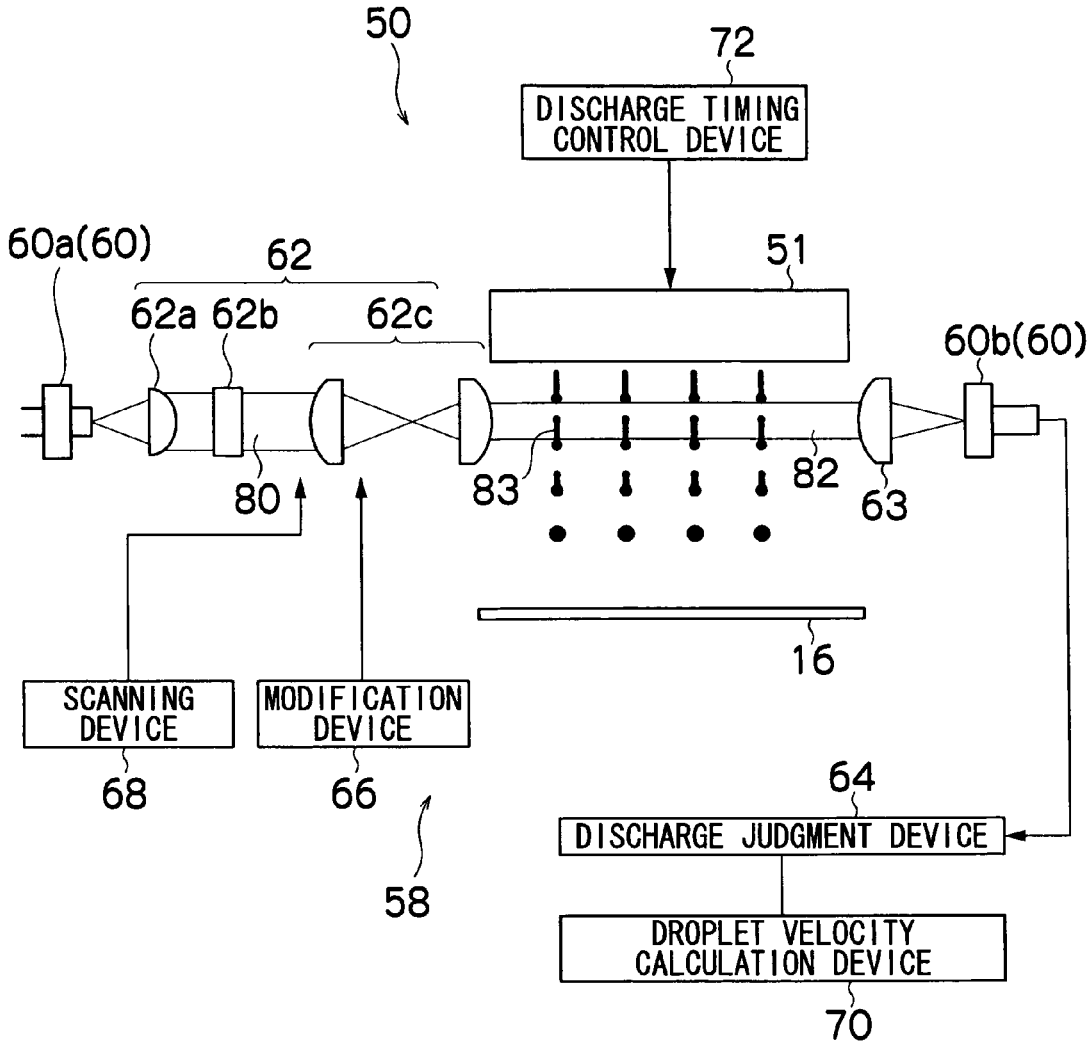
FIG. 5 is a schematic drawing including a partial block diagram showing the general composition of a print head unit comprising an ink determination device (droplet determination device)

Below, in order to describe the droplet determination device 58 according to the present embodiment in more detail, a general schematic view of the composition of the print head unit 50 comprising the droplet determination device 58 is shown in FIG. 5.

As shown in FIG. 5, the print head unit 50 according to the present embodiment comprises the ink (droplet) determination device 58 for determining ink (droplets) that has been discharged from a print head 51, which is an ink (droplet) discharge device for discharging ink. The ink determination device 58 is constituted principally by a detection device 60 including a light source 60*a*, such as a laser diode, and a light sensor 60*b*, an optical system 62 which forms a light beam emitted from the light source 60*a* into a light beam of a prescribed shape, and a discharge judgment device 64 which judges the discharge status upon receiving a detection signal from the detection device 60 (light sensor 60*b*).

The optical system 62 is constituted by a collimating lens 62*a* and a cylindrical lens 62*b* which form a light beam from the light source 60*a* into first parallel light, which is substantially parallel light of a first width, and a beam converter 62*c* which forms the first parallel light 80 into second parallel light 82, which is substantially parallel light of a different, second width. The beam converter 62*c* changes the beam width by restricting the light beam or enlarging the light beam in the lateral direction.

These optical systems for changing the parallel light into parallel light of a different width in a stepwise fashion, changing the width of the parallel light in a continuous fashion, or switching the width of the parallel light, are described in detail below.

The second parallel light 82 is formed in parallel with the longitudinal direction of the print head 51, between the print head 51 and the recording paper 16, and an ink droplet 83 is discharged from the print head 51 into the second parallel light 82. Here, the ink droplet 83 is discharged so as to have a direction of flight that is perpendicular to the direction of the optical axis of the second parallel light 82.

This second parallel light 82 is condensed by the condensing lens 63, in such a manner that the light is irradiated onto the light sensor 60*b*, approximately in the condensation point. The detection signal of the light sensor 60*b* is input to the discharge judgment device 64 in such a manner that the discharge status can be judged.

The ink determination device 58 also comprises: a modification device 66 for modifying the cross-sectional shape perpendicular to the optical axis of the second parallel light 82, a scanning device 68 for making the second parallel light 82 traverse onto an ink droplet 83 discharged from the print head 51, an ink (droplet) velocity determination device 70 for calculating the velocity of flight of an ink droplet 83 on the basis of a detection signal from the detection device 60, and a discharge timing control device 72 for controlling the print head 51 in such a manner that the discharge timings of respective ink droplets 83 are staggered when the print head 51 discharges a plurality of ink droplets 83 into the second parallel light 82. The discharge judgment device 64 and the ink velocity calculation device 70 are in fact constituted by the system controller 122, as shown in FIG. 4, and their respective calculations are carried out on the basis of a prescribed program. Furthermore, the discharge timing control device 72 is constituted by the print controller 130, and it controls the discharge timing under the control of the system controller 122. Moreover, the modification device 66 and the scanning device 68 are described hereafter with reference to concrete compositional examples.

The light source 60*a* of the detection device 60 is not limited in particular, and besides a laser diode as described above, it is also possible to use a solid-state laser, a gas laser, a light-emitting diode, an electro luminescence device, xenon lamp, metal halide lamp, cold cathode fluorescent tube, hot cathode fluorescent tube, halogen lamp, or the like.

Figure 6:
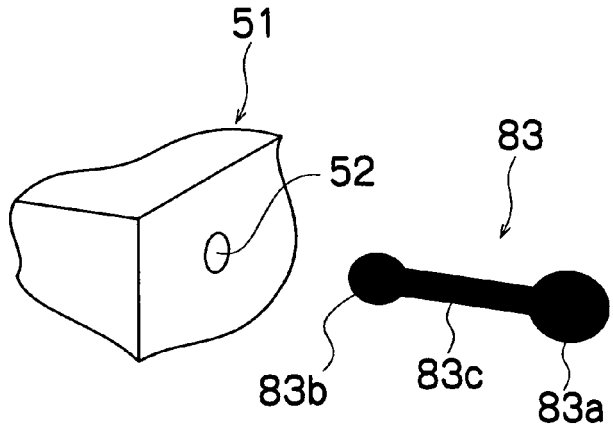
FIG. 6 is an illustrative diagram showing the state of an ink droplet discharged from a nozzle.

Here, as shown in FIG. 6, the ink droplets 83 discharged from the respective nozzles 52 of the print head 51 are not circular spheres upon discharge. Immediately after discharge from the nozzles 52, the ink droplet 83 forms a long, thin ink column including a large front-side sphere 83*a* and a small rear-side sphere 83*b*, which are connected together by a column 83*c*. Subsequently, the ink column may gradually becomes shorter and rounder, thus forming a single spherical ink droplet, or the column 83*c* may split, thus forming two spherical ink droplets, a large front-side sphere 83*a* and a small rear-side sphere 83*b*.

In this way, the distance from the nozzle 52 to point at which the ink droplet becomes round is directly proportion to the velocity of flight of the ink droplet 83, given uniform ink properties and uniform size of the ink droplet 83. Consequently, the time from the discharge of ink from the nozzle 52 until the ink droplet 83 becomes round is approximately the same. This is thought to be because the forces which pull the ink droplet into a round droplet state from a column state are the surface tension of the ink and the viscosity that forms a resistance to the formation of a sphere. If the shape of the ink column is approximately the same, then these forces will not depend on the velocity of flight of the ink and hence the time taken for the ink to change from a column into a sphere will be approximately the same.

Generally, the properties of the ink are, for example, surface tension of approximately 30 mN/m and viscosity of approximately 3 cP. Furthermore, the ink discharge velocity is approximately 10 m/sec immediately after discharge, and approximately 6 m/sec to 7 m/sec at the point where the ink droplet forms a spherical shape. In this case, according to experimental results, the position at which an ink droplet 83 becomes round is approximately 0.4 mm from the nozzle 52.

In this way, when the ink droplet 83 is in a state prior to forming a round droplet, the surface area is large and the discharge detection signal is also large. Consequently, if the ink droplet 83 is detected at a position closer to the nozzle 52, in the region up to at least 0.5 mm from the nozzle surface, then it is possible to detect the ink while it is in the form of a column, and since the column shape has a greater surface area than a spherical shape of the same volume, it is possible to obtain a larger detection signal.

Therefore, the cross-sectional shape of the second parallel light 82 in the direction perpendicular to the optical axis is elongated in the direction of flight of the ink droplet 83 to form an elliptical or rectangular shape, as shown by the hatched lines in FIG. 7, and the second parallel light 82 is positioned in such a manner that a column-shaped ink droplet 83 can be detected in a region of up to 0.5 mm from the nozzle surface 51*a* of the print head 51 (the surface in which the nozzles are arranged).

Furthermore, the width of the second parallel light 82 (namely, the beam width) is set to be greater than the length of the ink column, while remaining narrower than the distance between the print head 51 and the recording paper 16 (not illustrated in FIG. 7; see FIG. 5). The detection position at which the ink droplet 83 is detected by means of the second parallel light 82 should be a position which allows the ink droplet 83 to be detected while it forms a column. Furthermore, the second parallel light 82 is formed in such a manner that the width of the parallel light is different in the two directions of the plane perpendicular to the optical axis, so that the second parallel light 82 has a cross-sectional shape perpendicular to the optical axis such as that shown in FIG. 7. More specifically, the second parallel light 82 is formed so as to be long (broad) in the direction of flight of the ink droplet 83, and short (narrow) in the breadthways direction of the nozzle surface 51*a* of the print head 51. Here, taking the beam width in the long direction to be L and taking the beam width in the shorter direction perpendicular to same to be D, desirably, the ink droplet 83 is detected within the region where the ratio L/D is greater than or equal to 2 (i.e., $L/D \geqq 2$).

Figure 8:
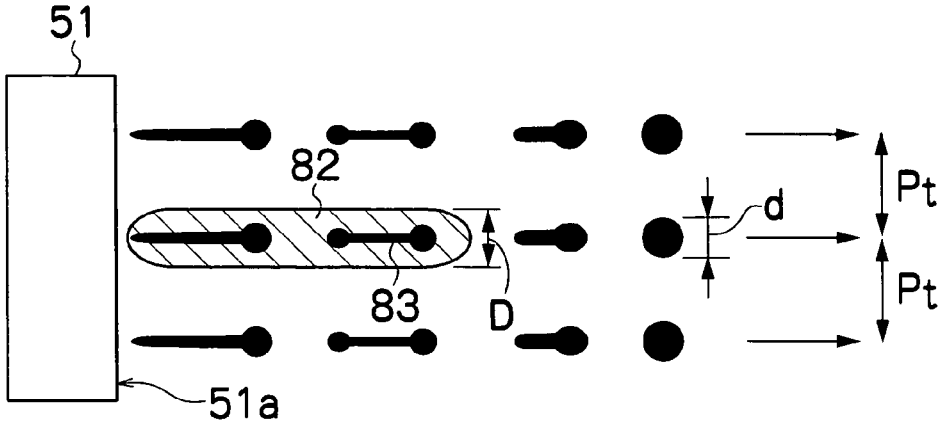
FIG. 8 is a side of FIG. 7 as viewed from the direction of emission of the parallel light.

Furthermore, in this case, desirably, the shorter width D of the second parallel light 82 is set to a value which will not encompass an ink droplet discharged from an adjacent nozzle, as depicted in FIG. 8 which shows the configuration in FIG. 7 as viewed from the side from which the second parallel light 82 is emitted. More specifically, taking the ink droplet diameter to be d μm and the nozzle pitch to be Pt μm, as shown in FIG. 8, then D should satisfy the relationship $D<2\times Pt-d$. Thereby, it is possible accurately to identify a nozzle suffering an abnormality.

Figure 9:
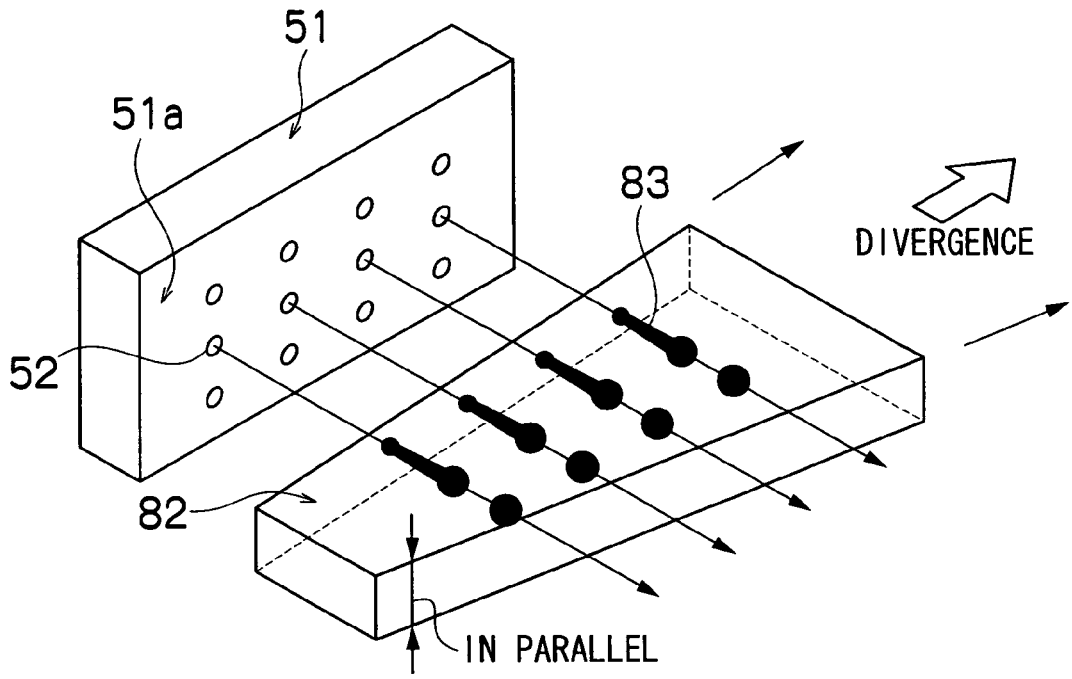
FIG. 9 is an illustrative diagram showing a further example of parallel light having a cross-sectional shape perpendicular to the optical axis that is long and thin in the direction of flight of the ink droplets.

Furthermore, in this case, the second parallel light 82 is substantially parallel to the breadthways direction of the nozzle surface 51*a*, as shown in FIG. 9, but it may also be formed into a diverging or converging light beam in the lengthwise direction of the nozzle surface (in FIG. 9, a diverging light beam is depicted). Although not shown in FIG. 9, the diverging light beam or converging light beam is composed so as to be incident on the condensing lens 63.

More specifically, in this case, as shown in FIG. 8 also, the light must be substantially parallel in the breadthways direction of the nozzle surface 51*a*, in order that it does not overlap with ink droplets discharged from adjacent nozzles in this breadthways direction, but in the lengthwise direction of the nozzle surface 51*a*, it may deviate from the parallel, since this does not cause interference with other ink droplets.

Figure 10:
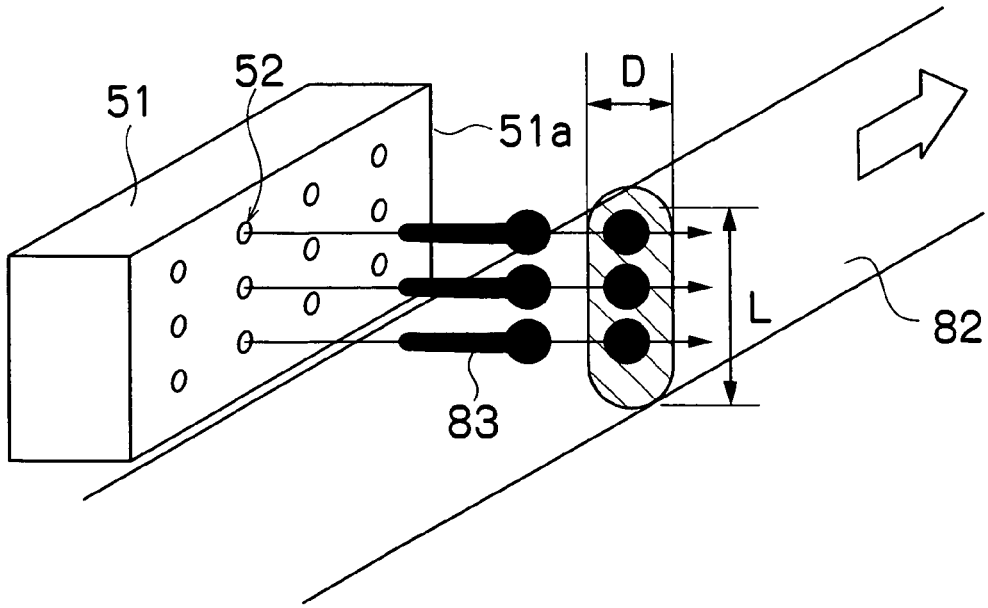
FIG. 10 is an illustrative diagram showing parallel light having a cross-sectional shape perpendicular to the optical axis that is long and thin in the direction perpendicular to the direction of flight of the ink droplets.

Furthermore, if the cross-sectional shape of the second parallel light 82 in the direction perpendicular to the optical axis is elongated in the breadthways direction of the nozzle surface 51*a*, thereby forming an elliptical or rectangular shape as shown in FIG. 10, then it is also possible to detect ink droplets 83 even if the beam position of the second parallel light 82 is displaced to some extent from the direction of flight of the ink droplet 83. More particularly, it is possible to detect a plurality of ink droplets 83 simultaneously, as shown in FIG. 10.

Furthermore, desirably, it is possible to modify the width L of the second parallel light 82 shown in FIG. 10, from a width for detecting ink droplets from one nozzle only, to a width which allows a plurality of nozzles spanning the entire width of the print head 51, as viewed in the detection direction, to be detected simultaneously.

The modification device 66 changes the cross-sectional shape of the second parallel light 82 perpendicular to the optical axis, between a long, thin shape that is elongated in the direction of flight of the ink droplets, as shown in FIG. 7, and a long, then shape that is elongated in the breadthways direction of the nozzle surface 51*a*, as shown in FIG. 10.

There follows a detailed description of a concrete compositional example of a beam converter 62*c* which changes parallel light into parallel light of a different width in a stepwise fashion or in a continuous fashion, and a modification device 66 which switches the cross-sectional shape of the parallel light in the direction perpendicular to the optical axis.

Firstly, the beam converter 62*c* is a lens system which inputs first parallel light 80 obtained by collimating light from the light source 60*a* by means of a collimating lens 62*a* and a cylindrical lens 62*b* and converts this light into a second parallel light 82 of a different width. Generally, the beam converter 62*c* is formed by an optical system similarly to that of a "telescope", in which both the incident light and the emitted light are parallel light beams when viewing an object at infinity. In other words, if light is input from the "eyepiece lens side" to a telescope optical system, then the telescope optics function as a beam expander. An example of the basic composition of an optical system of this kind is described below.

Figure 11A:
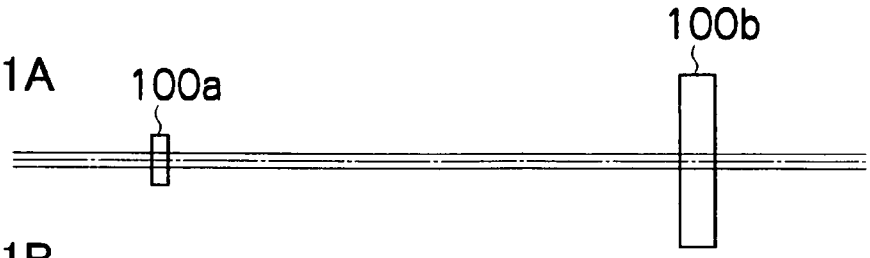
Figure 11B:
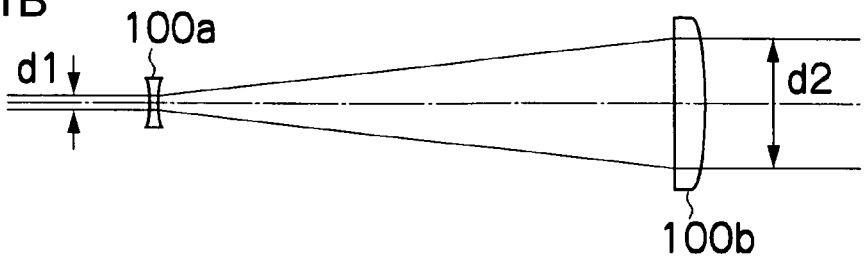

The system shown in FIGS. 11A and 11B is a first example of the basic composition of an optical system in which parallel light obtained by collimating light from a light source is converted into parallel light of a different width. FIG. 11A shows a plan view and FIG. 11B shows a front view. This is a Galileo type beam expander optical system, wherein lens 100*a* is a concave lens which causes the light to diverge and lens 100*b* is a convex lens which collimates the light, in particular in the direction illustrated in FIG. 11B of the two axes that are perpendicular to the optical axis. In this way, the lens 100*a* and the lens 100*b* function as a beam expander which converts the beam width from d1 to d2. Furthermore, as shown in FIG. 11A, in the other direction perpendicular to the optical axis, a cylindrical type beam expander of zero optical power is formed. Thereby, it is possible to form a parallel light beam having a rectangular shape of different sizes in the vertical and horizontal directions.

Figure 12A:
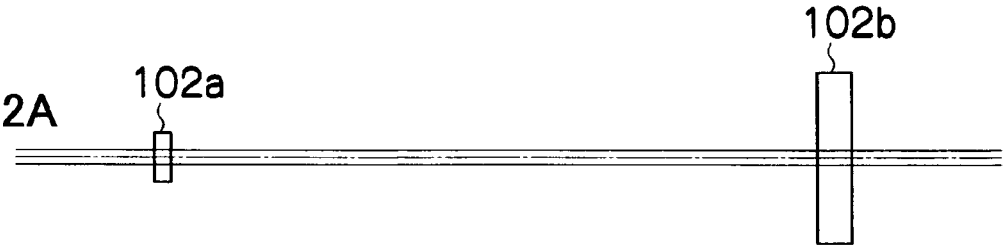
Figure 12B:
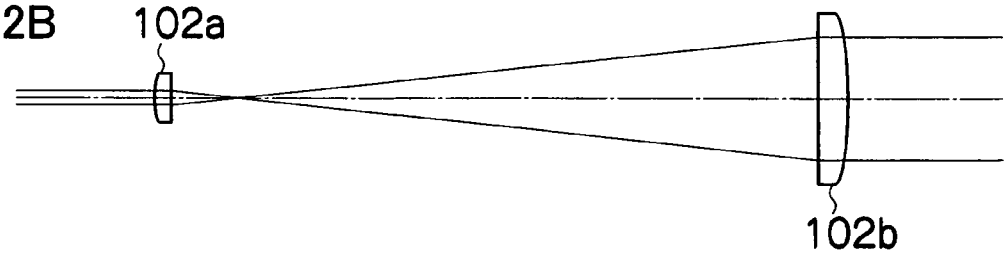

Next, FIGS. 12A and 12B show a second example of the basic composition of an optical system of this kind. FIG. 12A is a plan view and FIG. 12B is a front view. This second example is a Kepler type beam expander optical system, in which lens 102*a* and lens 102*b* are both convex lenses that function as a beam expander and change the beam width, in particular in the direction shown in FIG. 12B of the two axes that are perpendicular to the optical axis. Furthermore, as shown in FIG. 12A, in the other direction perpendicular to the optical axis, a cylindrical type beam expander of zero optical power is formed. Either of the optical systems in FIGS. 11A and 11B or in FIGS. 12A and 12B can be used as a beam expander.

Figure 13A:
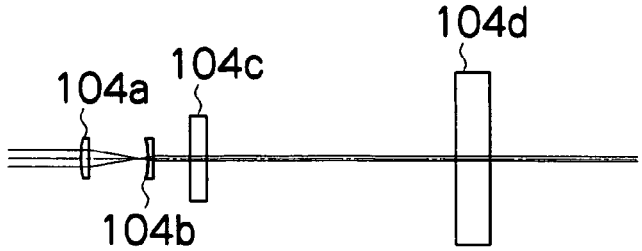
Figure 13B:
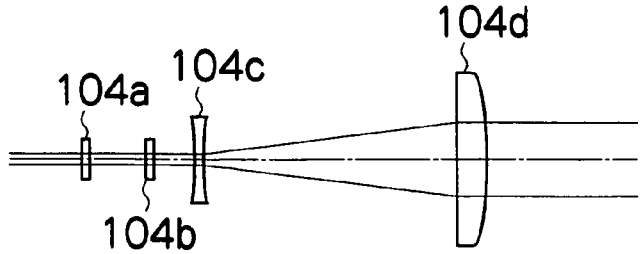

Furthermore, a third example of the basic composition is shown in FIGS. 13A and 13B, wherein two Galileo type beam expanders as illustrated in FIGS. 11A and 11B having respectively different focal lengths are coupled together in series in a mutually facing arrangement. More specifically, as shown in FIG. 13A, lens 104*a* is a convex lens, lens 104*b* is a concave lens, and lens 104*c* and lens 104*d* are cylindrical lenses having no optical power. At the same time, as shown in FIG. 13B, lens 104*a* and lens 104*b* are cylindrical lenses having no optical power, lens 104*c* is a concave lens and lens 104*d* is a convex lens.

In this case, in the direction illustrated in FIG. 13A, the parallel light beam is narrowed by the beam expander including the lens 104*a* and the lens 104*b* in the front light input stage. In the direction illustrated in FIG. 13B, the parallel light beam is broadened by the beam expander including the lens 104*c* and the lens 104*d* in the following light input stage.

Figure 14A:
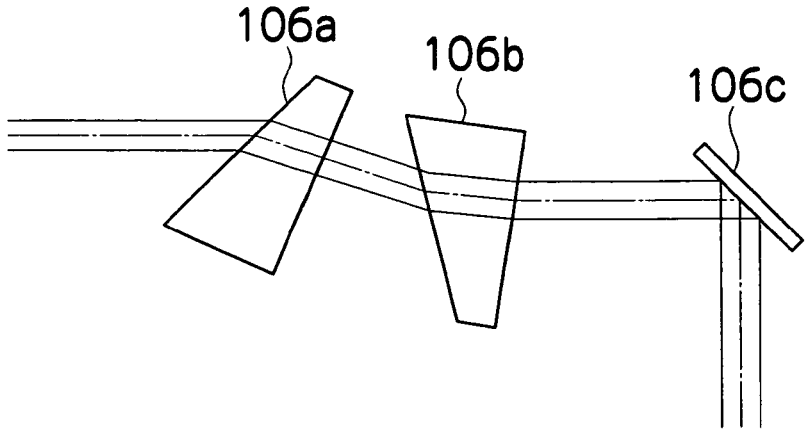
Figure 14B:
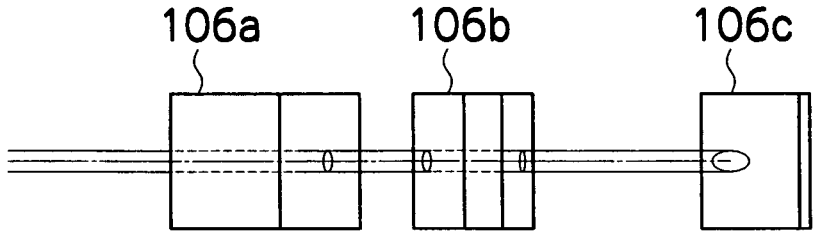

Furthermore, FIGS. 14A and 14B show a fourth example of the basic composition. This example uses a beam expander based on an anamorphic prism. FIG. 14A is a plan view and FIG. 14B is a front view. As shown in these diagrams, by using quadrilateral cylinder-shaped prisms 106*a* and 106*b* having a trapezoid cross-section, it is possible to change the width of the emitted light beam in a continuous fashion, in accordance with the angle of incidence of the parallel light (see FIGS. 17A and 17B). By using a pair of prisms 106*a* and 106*b* and disposing them in a suitable positional relationship, it is possible to make the incident light axis and the emitted light axis mutually parallel (although the two axes do not coincide with each other). Furthermore, by using two prisms 106*a* and 106*b*, it becomes possible to change the width of the parallel light beam through a greater range.

Moreover, in FIGS. 14A and 14B, a plane mirror 106*c* is disposed after the prisms 106*a* and 106*b*, and the optical axis of the parallel light after width conversion can be set to a uniform direction by adjusting the position of this mirror 106*c*. Furthermore, in this case, the optical axis of the light after passing through the prisms 106*a* and 106*b* does not have to be parallel with the incident light, and it is possible to ensure that the optical axis of the emitted light after reflection by the mirror 106*c* lies a uniform direction at all times, by simultaneously adjusting the position and angle of the mirror 106*c*.

Next, an example of the composition of an optical system which can vary the width of the parallel light beam, in other words, change the relationship between the width of the incident light and the emitted light, will be described.

Firstly, in a system using a lens as illustrated in FIGS. 11A and 11B or FIGS. 12A and 12B described above, a commonly known zoom type optical system is used for one or both of the input side lens on the left-hand side in the diagram and the output side lens on the right-hand side, and by altering the focal distance, the relationship between the widths of the incident light and the emitted light can be varied in a continuous fashion. In this case, a zoom optical system using a cylindrical lens is formed, as shown in FIGS. 11A and 11B, and FIGS. 12A and 12B.

Figure 15A:
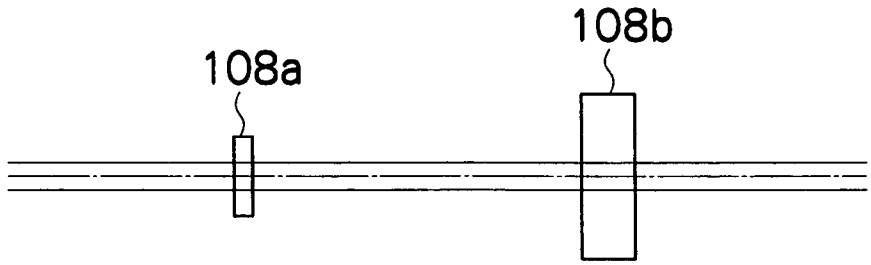
Figure 15B:
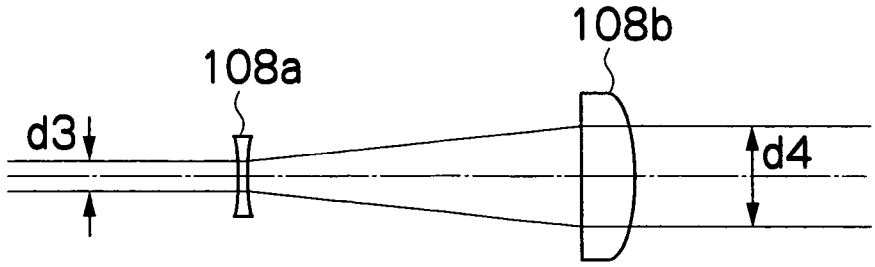

FIGS. 15A and 15B show a first compositional example in which the width of the parallel light can be varied. FIG. 15A is a plan view and FIG. 15B is a front view. This example uses a similar optical system to that illustrated in FIGS. 11A and 11B, being constituted by a lens 108*a* which is a concave lens in one direction perpendicular to the optical axis and a cylindrical lens in the other direction, and a lens 108*b* which is a convex lens in the one direction and a cylindrical lens in the other direction. However, in this case, the focal length of the lens 108*b* on the output side, in particular, is shortened in comparison to the example in FIGS. 11A and 11B.

More specifically, it is possible to change the relationship between the width d3 of the incident light and the width d4 of the emitted light by modifying the focal length of the lens 108*b* on the output side. Thereby, it is possible to prepare a plurality of optical systems such as those illustrated in FIGS. 11A and 11B and FIGS. 15A and 15B, having different focal lengths of the lens on the output side, in such a manner that a parallel light beam of the required width can be obtained by switching between these systems. However, since this requires the provision of a plurality of optical systems, the device composition becomes more complicated.

Figure 16A:
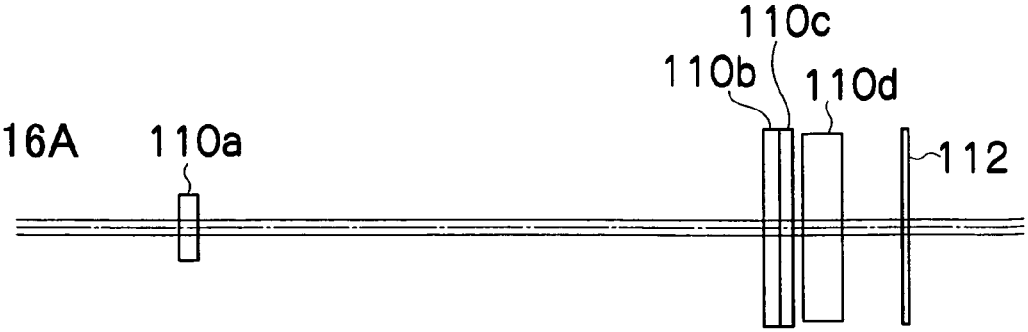
Figure 16B:
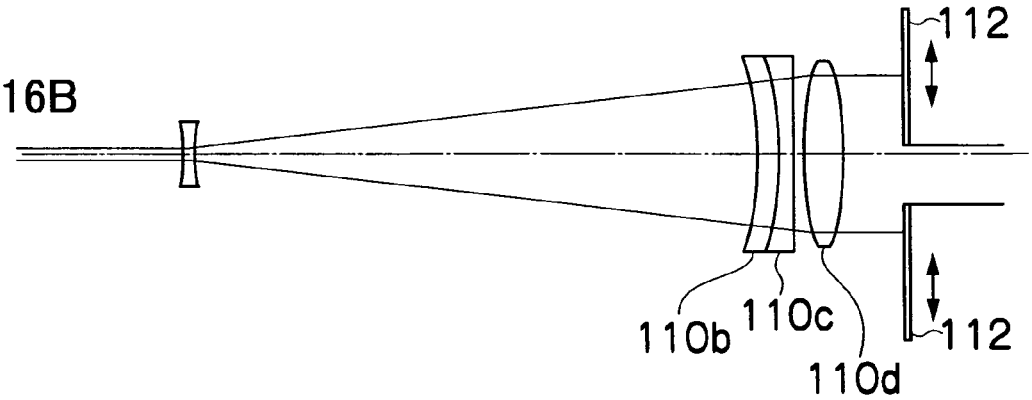

FIGS. 16A and 16B show a second compositional example in which the width of the parallel light can be varied. In this example, a movable aperture that varies the width of the parallel light is disposed on the output side. FIG. 16A is a plan view and FIG. 16B is a front view. As shown in FIGS. 16A and 16B, the basic lens configuration in this example is the same as that shown in FIG. 10, with the lens 110*a* on the input side being a concave lens in one direction perpendicular to the optical axis and a cylindrical lens in the other direction, and the lens 110*d* on the output side being a convex lens in one direction perpendicular to the optical axis and a cylindrical lens in the other direction. Moreover, in this example, a movable aperture 112 for varying the width of the parallel light is disposed after the lens 110*d* on the output side. The aperture 112 is driven as illustrated by the arrows in FIG. 16B, in such a manner that the width of the parallel light beam can be altered by adjusting the gap formed by the aperture 112.

Moreover, in this example, any error can be corrected satisfactorily by combining a plurality of lenses 110*b* and 110*c* with the output-side lens 110*d*. In this way, by using an optical system which is corrected for error, a composition is achieved which is suitable for passing a parallel light beam through a relatively long distance, as is the case when detecting ink droplets as in the present invention.

Figure 17A:
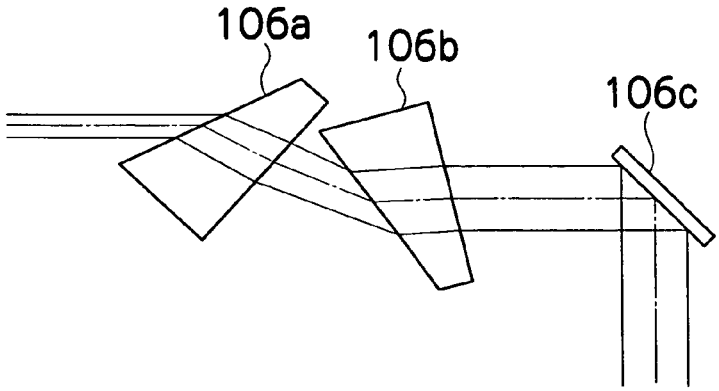
Figure 17B:
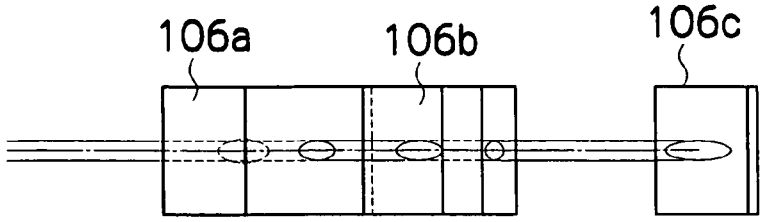

Furthermore, FIGS. 17A and 17B show a third compositional example in which the width of the parallel light can be varied. In this example, the width of the parallel light beam is varied by changing the positional relationship between two prisms, as illustrated in FIGS. 14A and 14B. FIG. 17A is a plan view and FIG. 17B is a front view. The composition is similar to that in FIGS. 14A and 14B, and the width of the parallel light is varied by altering the positional relationship between the two prisms 106*a* and 106*b*.

Next, a modification device 66 which switches the parallel light beam between a beam whose cross-sectional shape perpendicular to the optical axis of the parallel light is elongated in the direction of flight of the ink droplets and a beam whose cross-sectional shape is elongated in a perpendicular direction to this direction of flight.

One method for switching the vertical and horizontal dimensions of the parallel light beam is a method which rotates the optical system about the optical axis. More specifically, in the optical systems illustrated in FIGS. 11A to 17B described above, since the effects on the incident parallel light are different in the two directions perpendicular to the optical axis, with the exception of the configurations illustrated in FIGS. 14A and 14B and FIGS. 17A and 17B which use prisms, it is possible to switch from a parallel light beam having a long cross-section in the vertical direction to a parallel light beam having a long cross-section in the horizontal direction, as shown in FIGS. 7 and 10, by rotating the optical system through 90° about the optical axis. Furthermore, in the case of FIGS. 14A and 14B or FIGS. 17A and 17B, it is possible to switch the width of the parallel light in a similar fashion by rotating the prism sections through 90° about the optical axis of the emitted light. In this case, the modification device 66 is constituted by a drive system which mechanically rotates the optical system (lenses or prisms). Any composition is valid which allows the dimensional relationship of the parallel light beam in the two directions perpendicular to the optical axis to be switched.

Moreover, a further, possible method for switching the vertical and horizontal dimensions of the parallel light beam is a method in which two beam expanders for varying the width of the parallel light beam as illustrated in FIGS. 15A to 17B are used in a serial arrangement, in such a manner that the width of the parallel light is changed independently and respectively in the two directions perpendicular to the optical axis. The configuration shown in FIGS. 13A and 13B also comprises two beam expanders in a serial arrangement, but by using two beam expanders such as those illustrated in FIGS. 15A to 17B in a serial arrangement of this kind, and also enabling the width of the parallel light to be changed independently in the two direction perpendicular to the optical axis, it is possible to convert parallel light having a long cross-section in the vertical section into parallel light having a long cross-section in the horizontal section.

In this case, in particular, by using a device such as a zoom lens or an anamorphic prism pair, or the like, which allows the width of the parallel light beam to be varied in a continuous fashion, then it is possible to switch between the states in FIGS. 7 and 10 continuously, and hence this represents a suitable composition in view of the object of the present invention.

In the present embodiment, an ink droplet is discharged through a parallel light beam, the determination light thereof is received, and the determination status is evaluated on the basis of this detection signal. However, if a plurality of ink droplets discharged from a plurality of nozzles are to be detected simultaneously, then the discharge timings from the respective nozzles are each delayed respectively by a small amount, thereby creating staggered discharge timings, in such a manner that the ink droplets traverse the light beam in a sequential fashion.

Figure 18:
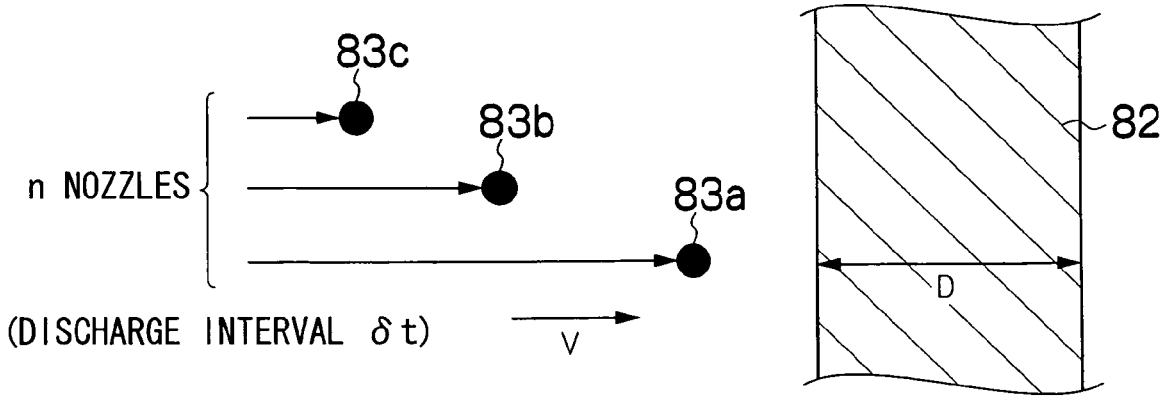
FIG. 18 is an illustrative diagram showing an example of a case where a plurality of ink droplets are determined simultaneously.

For example, as shown in FIG. 18, if three ink droplets 83*a*, 83*b* and 83*c* are detected simultaneously by the second parallel light 82, then the discharge timing control device 72 controls the print head 51 in such a manner that, firstly, a first ink droplet 83*a* is discharged from one nozzle (none of the nozzles being illustrated in the drawing), whereupon, after a small delay, a second ink droplet 83*b* is discharged from a subsequent nozzle, whereupon, a third ink droplet 83*c* is discharged from a subsequent nozzle.

In FIG. 18, taking the discharge interval between the ink droplets 83*a*, 83*b* and 83*c* as δt sec, the velocity of flight of the ink droplets as V m/sec, the number of droplets in flight subject to droplet determination, as n, and the width of the beam of parallel light, as D μm, then desirably, the discharge interval δt is set in such a manner that the relationship, $\delta t \times V \times (n-1) < D \times 10^{-6}$, is satisfied.

Figure 19:
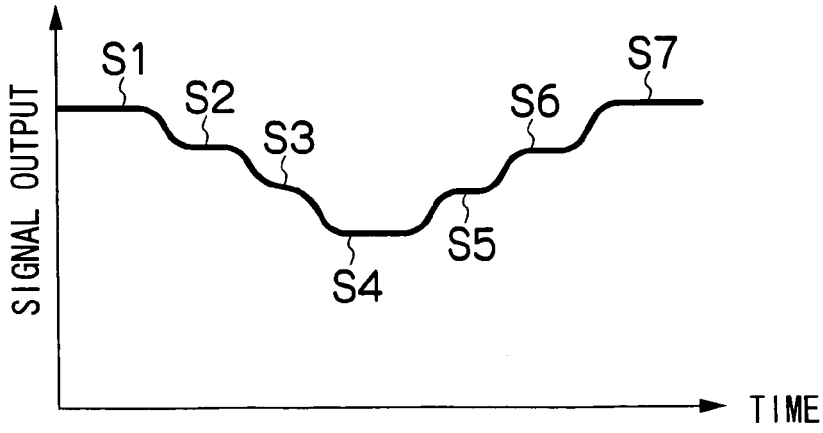
FIG. 19 is a graph showing an example of a detection signal in the example shown in FIG. 18.

FIG. 19 shows an aspect of the detection signal in this case. If none of the ink droplets 83*a*, 83*b* and 83*c* has yet entered into the light path of the second parallel light 82, then the light is not interrupted at all and the output of the detection signal is a large value as indicated by s1. Thereupon, when the first ink droplet 83*a* enters into the light path, the light intensity falls accordingly, and the output of the detection signal also falls slightly to s2. Thereupon, when the second ink droplet 83*b* enters into the light path, the light intensity falls further, due to the presence of the two ink droplets 83*a* and 83*b*, and the output of the detection signal falls further to s3.

Next, when the third ink droplet 83*c* enters into the light path, there will be three ink droplets 83*a*, 83*b* and 83*c* present in the light path, and hence the light intensity falls to its lowest value and the output of the detection signal also becomes a minimum value, as indicated by s4. Subsequently, when the first ink droplet 83*a* exits from the light path, there are two ink droplets 83*b* and 83*c* in the light path, the light intensity increases slightly, and the output of the detection signal becomes s5. Thereafter, when the second ink droplet 83*b* also exits from the light path, the only droplet in the light is the third ink droplet 83*c*, and the output of the detection signal becomes s6. Finally, when the third ink droplet 83*c* exits from the light path, the detection signal returns again to the same level s7 as its initial level (=s1).

In this way, by staggering the discharge timings for a plurality of ink droplets 83*a*, 83*b* and 83*c*, respectively by a small amount, a step-shaped output waveform such as that illustrated in FIG. 19 is obtained. Any discharge abnormalities can be detected by comparing the discharge timings of the plurality of ink droplets 83*a*, 83*b* and 83*c* with the output waveform of the obtained detection signal. If the shifts between the discharge timings ink droplets 83*a*-83*c* are relatively large, then rather than obtaining a step-shaped waveform as in FIG. 19, an output waveform simply including three similar pulse waveforms corresponding to the number of droplets, will be obtained.

Furthermore, if the second parallel light 82 used to detect the ink droplets 83 has an intensity distribution, such as the Gaussian beam of a laser, then when the ink droplets are of approximately the same size, it is possible to determine the position of transit of an ink droplet 83 through the centre of the parallel light beam from the magnitude of the detection signal. Consequently, if the positional relationship between the nozzles and the parallel light beam is previously specified, then it is possible to determine the direction of flight of an ink droplet 83, namely, whether the ink droplet 83 is discharged from the nozzle 52 in a perpendicular direction to the nozzle surface 51*a*, or in an oblique direction.

If the ink droplet 83 is smaller, then there is a risk that the detection signal will become smaller even if the droplet passes through the central region of the parallel light beam, or that the droplet will be detected by passing through a position other than the center of the parallel light beam. However, since a case where the ink droplet 83 flies in an oblique direction, or a case where the ink droplet is small and differs from a prescribed size are both undesirable, then it is necessary to carry out a maintenance operation, such as cleaning of the print head 51, in both of these cases. Therefore, it is not particularly necessary to distinguish between a flight direction abnormality and an ink size abnormality.

Next, an ink droplet determination method is described.

A light beam is emitted from the light source 60*a* and this is converted into a prescribed parallel light beam as illustrated in FIG. 7 or FIG. 10 by the optical system 62. An ink droplet 83 is discharged into this parallel light beam (the second parallel light 82). In this case, in the case of a parallel light beam as illustrated in FIG. 7, for example, then it is possible simultaneously to detect ink droplets 83 discharged from a plurality of nozzles 52 in the row direction, of the nozzles 52 arranged in a matrix configuration in the print head 51. Furthermore, in the case of a parallel light beam as illustrated in FIG. 10, for example, then it is possible simultaneously to detect ink droplets 83 discharged from a plurality of nozzles 52 in the column direction, of the nozzles 52 arranged in a matrix configuration in the print head 51.

If an abnormality is determined when a plurality of ink droplets 83 discharged from a plurality of nozzles 52 are simultaneously detected, then it is necessary to focus down to the nozzle 52 suffering the abnormality by varying the detection range and the number of ink droplets 83 detected.

Furthermore, in this case, if second parallel light 82 as illustrated in FIG. 7 is used and if detection is to be performed for another row of nozzles arranged in the matrix configuration of the print head 51, then it is necessary to scan the print head 51 with the second parallel light 82 by means of a scanning device 68.

Figure 20:
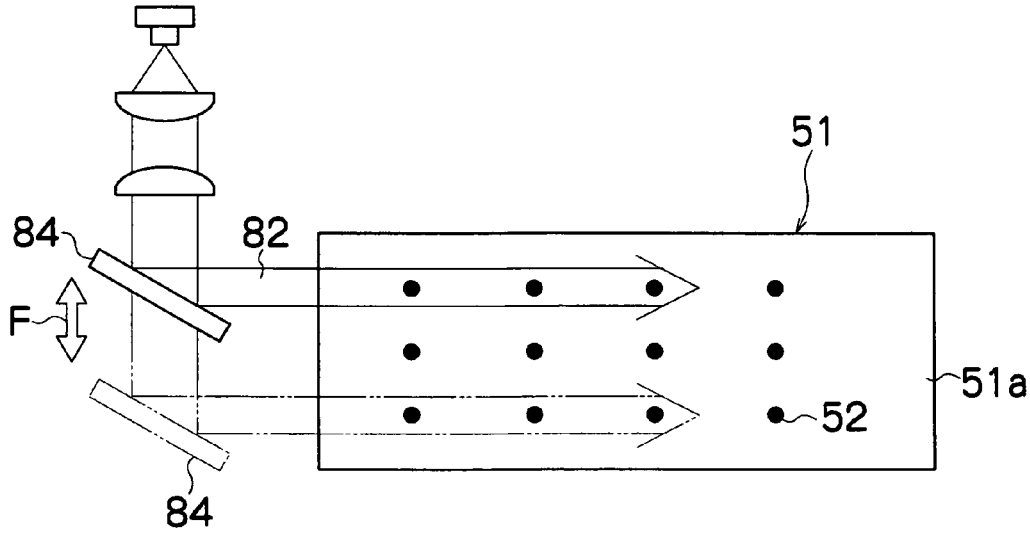
FIG. 20 is a schematic drawing showing an example of a device for making parallel light traverse.

For example, as shown in FIG. 20, a mirror 84 is provided in the light path, and the second parallel light 82 is reflected by the mirror 84, thereby changing its optical axis to a direction parallel to the lengthwise direction of the nozzle surface 51*a* of the print head 51, in such a manner that the second parallel light 82 is emitted in parallel with the nozzle surface 51*a* of the print head 51. By moving the mirror 84 upwards and downwards as indicated by the arrow F in FIG. 20, the second parallel light 82 is made to traverse over the nozzle surface 51*a* in a parallel fashion with same, while maintaining a substantially parallel state with respect to the lengthwise direction and the breadthways direction of the nozzle surface 51*a*. Naturally, it is also possible to move the whole optical system, but it is beneficial in terms of simplifying the composition and reducing costs, if only the mirror 84 is moved.

In this way, a detection signal obtained by the detection device 60 is sent to the discharge judgment device 64, which judges the discharge status by analyzing the detection signal as illustrated in FIG. 19, for example.

Alternatively, it is also possible to determine an abnormal nozzle accurately by means of the following method. More specifically, firstly, a plurality of ink droplets 83 are detected simultaneously by means of second parallel light 82 having an elliptical or rectangular cross-sectional shape perpendicular to the optical axis of the light beam that is elongated in the breadthways direction of the nozzle surface 51*a*, as shown in FIG. 10. If it considered that the related plurality of nozzles 52 includes a nozzle 52 which may be suffering a discharge failure, then, as shown in FIG. 7, a second parallel light 82 having an elliptical or rectangular cross-sectional shape perpendicular to the optical axis of the light beam, that is elongated in the direction of flight of the ink droplets 83, is used to establish the nozzle suffering a discharge failure, from the plurality of nozzles 52 which may be suffering a discharge failure.

Furthermore, desirably, the second parallel light 82 can be made to traverse in such a manner that at least a position of the print head 51 corresponding to a certain range of nozzles 52 can be determined. As a method for scanning a certain range of the nozzles 52 of the print head 51 in this way, it is possible, for example, to make the second parallel light 82 traverse in a fan shape 87 having a central point 86 situated on a straight line perpendicular to the lengthwise direction of the print head 51, in the vicinity of the center of the print head 51 in this lengthwise direction, as illustrated in FIGS. 21A and 21B.

Figure 21A:
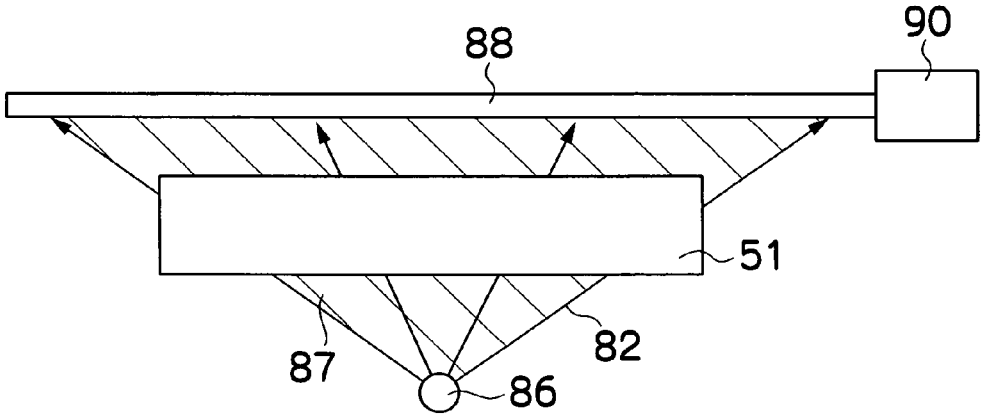

FIG. 21A is a plan view, and in the print head 51 depicted in FIG. 21A, the nozzle surface corresponds to the rear surface of the sheet of the drawings, and the ink droplets are discharged in the rearward direction with respect to the sheet. The second parallel light 82 is made to traverse in such a manner that it creates a fan shape 87 having a central point 86 situated in the central region of the lengthwise direction of the nozzle surface 51*a* and separated by a small distance from the print head 51. A light guide 88 is provided to the edge of the print head 51 which the scanning light of the second parallel light 82 reaches after the ink droplets have passed through the light. The second parallel light 82 is received by the light guide 88 disposed to the rear of the print head 51, and is guided to a light sensor 90 disposed in the end portion of the light guide 88. One of a plurality of light sensors 90 may be provided.

Figure 21B:
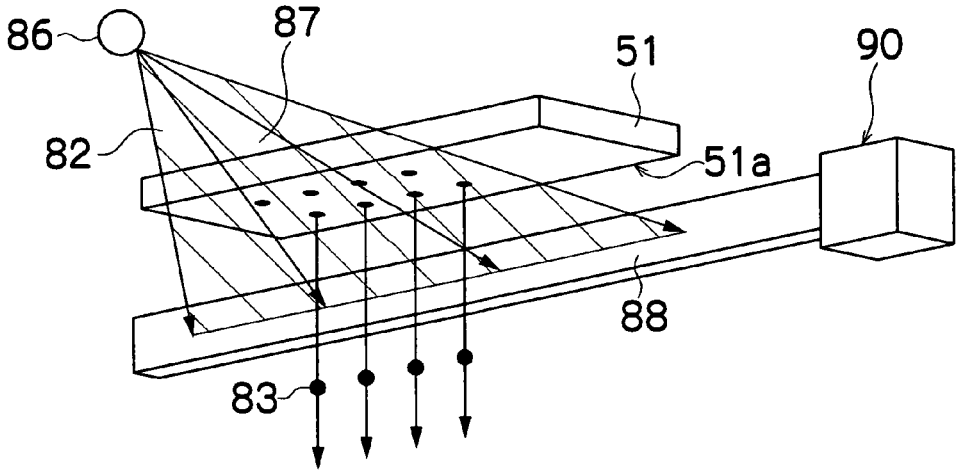

Furthermore, FIG. 21B shows an oblique view from the under side. The fan shape 87 formed by the second parallel light 82 intersects perpendicularly with the direction of flight of the ink droplets 83 discharged from the nozzle surface 51*a* on the lower face of the print head 51. In the depicted example, a combination of a light guide 88 and a light sensor 90 were used, but it is also possible to adopt a composition in which a light sensor is arranged in the form of a bar throughout the whole lengthwise dimension of the print head 51.

There follows a description of a method for determining the ink droplet size (ink droplet volume) from the height of the pulse of the detection signal, and a method for determining the velocity of the ink droplet from the height and width of the pulse, by means of the detection device 60.

Figure 22:
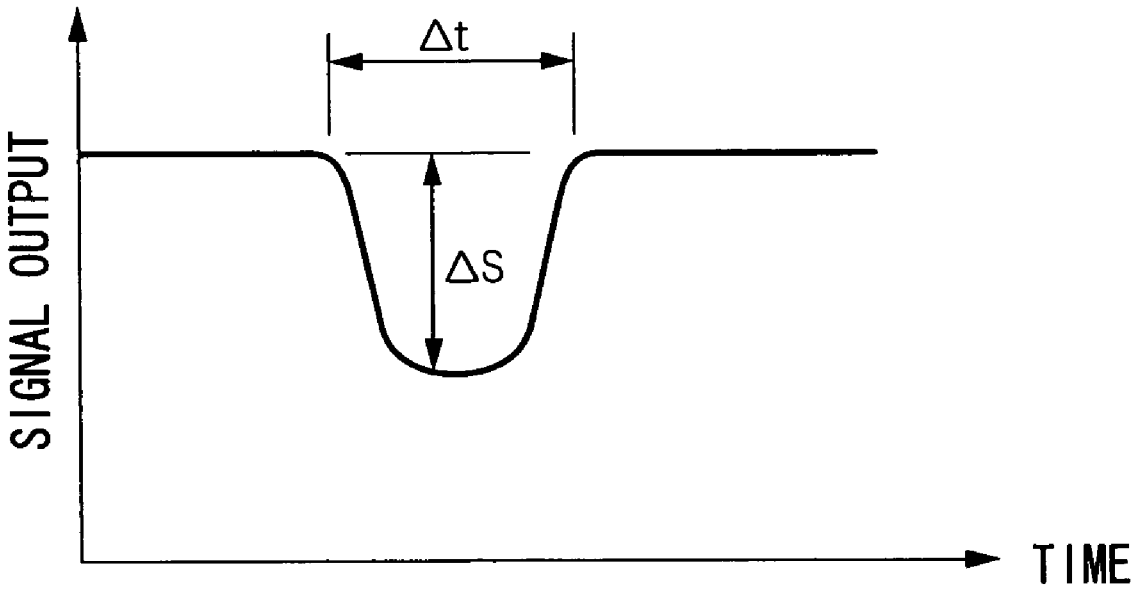
FIG. 22 is a graph showing an example of a detection signal in a case where the velocity of the ink droplet is determined.

FIG. 22 shows the output waveform of a detection signal corresponding to one ink droplet 83. As shown in FIGS. 21A and 21B, during the time period Δt that the ink droplet 83 is transiting the light path, the light is interrupted, the light intensity declines, and the output of the detection signal falls by a maximum amount of ΔS. This maximum value ΔS of the fall in the output signal is determined by the light intensity, the beam shape, the position of transit of the ink droplet in the beam, and the size of the ink droplet.

Here, assuming that the first three of these conditions are uniform, then since there is a one-to-one correspondence between the ink droplet size and the fall in the output signal, it is possible to determine the ink droplet size from the amount by which the output signal falls. This one-to-one relationship f(x) can be determined readily by means of experimentation, and desirably, a table of corresponding values is created previously on the basis of experiments.

Furthermore, since the beam shape varies slightly between a position near the light source and a position near the sensor, it is even more desirable to have a plurality of correspondence value tables, for each respective nozzle position.

As shown in FIG. 22, taking the fall in the output signal to be ΔS, and the relationship between the ink droplet size D and the fall in the output signal ΔS to be f(x), then the ink droplet size D can be determined by means of the following equation (2):

$$D=f(\Delta S). \tag{2}$$

Next, the duration Δt of the fall in the output signal in FIG. 22 is determined on the basis of the beam shape, the transit position of the ink droplet in the beam, namely, the width of the beam, the ink droplet size and the ink droplet velocity. If the ink droplet size D is determined on the basis of equation (2) above, then it is possible to determine the velocity of the ink droplet, provided that the beam width is uniform.

Moreover, if the ink droplet intercepts the edge of the beam where the light intensity is low, then determination accuracy will be poor. Therefore, an error correction value for correcting this error can be determined readily on the basis of experimentation, for each beam width and ink droplet size.

Therefore, taking the beam width to be W μm, the fall duration in the output signal to be Δt sec, and the error correction value for each beam width and ink droplet size to be ϵ(W, D) m/sec, the velocity of the ink droplet V m/sec can be calculated by means of the following equation (3):

$$V=(W+D)\times 10^{-6}/\Delta t+\epsilon(W, D). \tag{3}$$

Furthermore, since the beam shape varies slightly between a position near the light source and a position near the sensor, it is even more desirable to provide values for W and ϵ(W, D) in respect of each nozzle position.

More specifically, the droplet velocity calculation device 70 receives the data required for calculating the velocity of the ink droplet, from the discharge judgment device 64, and calculates the ink droplet velocity V on the basis of equation (3) above.

Figure 23:
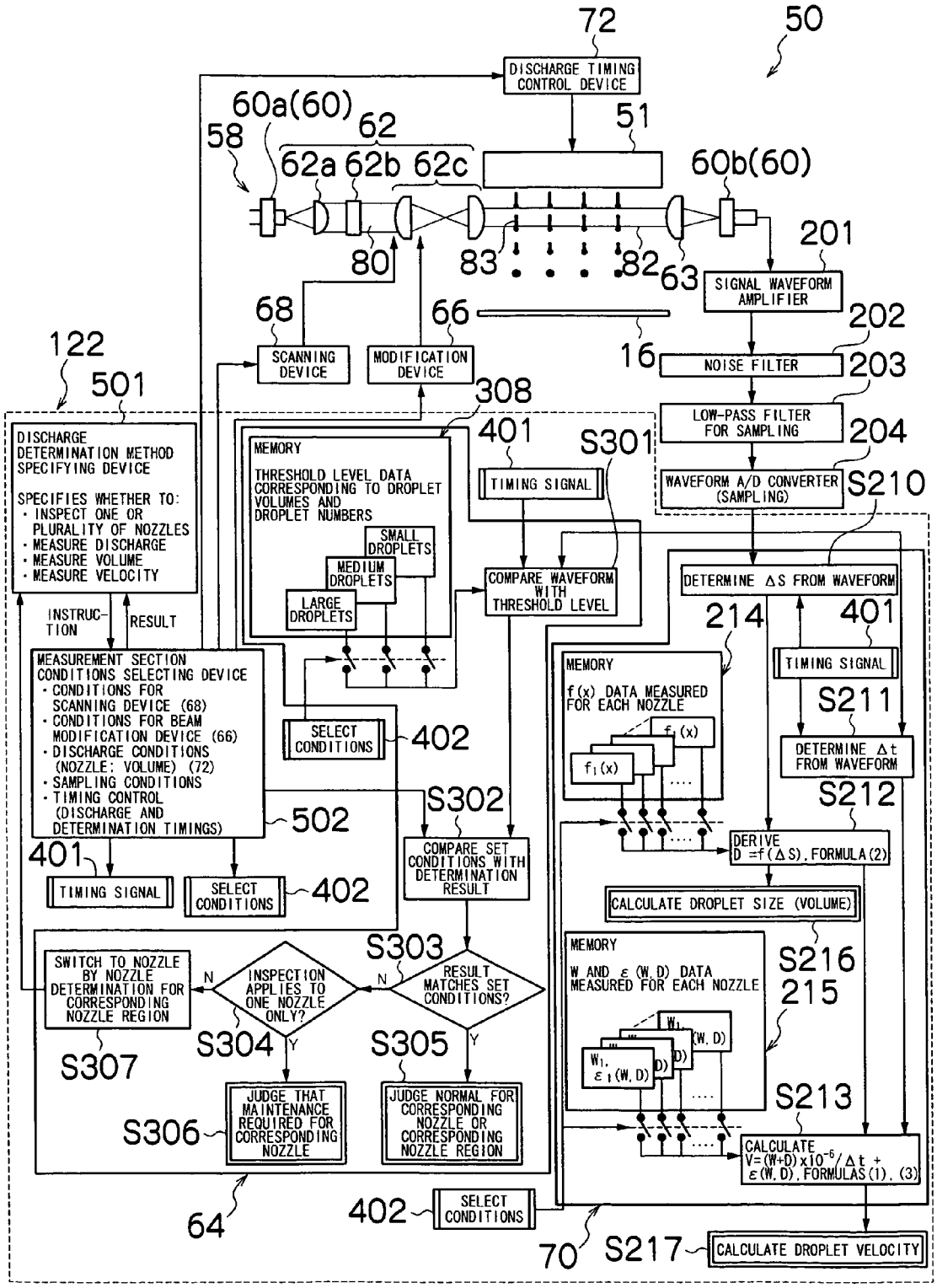
FIG. 23 is an illustrative diagram showing the details of a droplet discharge determination method.

FIG. 23 shows the contents of a droplet determination method, and provides a more detailed illustration of a discharge determination method. More specifically, the system controller 122 comprises a discharge determination method specifying device 501 and a measurement section conditions specifying device 502, as shown in FIG. 23.

The discharge determination method specifying device 501 specifies whether to inspect one nozzle or a plurality of nozzles, and which nozzle or nozzles is/are to be inspected. Furthermore, the discharge determination method specifying device 501 decides the determination method to be used, namely, whether to determine if an ink droplet has actually been discharged by the nozzle, or to determine the discharged volume of a droplet discharged by the nozzle (droplet volume), or to determine the discharge velocity of a droplet discharged by the nozzle (droplet velocity). The result of this decision is supplied to the measurement section conditions specifying device 502.

In accordance with instructions from the discharge determination method specifying device 501, the measurement section conditions specifying device 502 specifies the scanning conditions of the scanning device 68, the conditions of the beam modification device 66, the discharge conditions of the discharge timing control device 72 (relevant nozzles, discharge volume), and the sampling conditions of the waveform A/D converter 204, and supplies the determination results respectively to the relevant units.

Consequently, an ink droplet 83 discharged from the print head 51 is detected by the detection device 60, and the ink droplet detection signal output by the light sensor 60*a* is amplified to a suitable amplitude by a signal waveform amplifying device 201. Moreover, noise of unwanted frequencies is reduced by means of a noise filter 202 having low-pass, high-pass or band-pass characteristics, whereupon, in order to prevent fold-back distortion during sampling, the high-frequency component of the signal is reduced by a sampling low-pass filter 203 having a shut-off frequency equal to or less than ½ of the sampling frequency. The signal is then converted into a digital signal by a waveform A/D converter 204.

The ink droplet detection signal converted into a digital signal by the waveform A/D converter 204 is supplied to the system controller 122, and the following processes are then carried out by the discharge judgment device 64 and the droplet velocity calculation device 70.

Firstly, at step S301, the waveform is compared with a threshold level, and furthermore at step S210, the value of ΔS is determined from the waveform, and at step S211, the value of Δt is determined from the waveform. In this, in order that the comparison between the waveform and the threshold level (step S301), the determination of ΔS from the waveform (step S210), and the determination of Δt from the waveform (step S211) are each carried out at suitable timings with respect to the ink droplet detection signal, the operations are synchronized by means of a timing signal 401 that is output by the measurement section conditions specifying device 502.

Firstly, the comparison between the waveform and the threshold level at step S301 will be described. In this comparison between the waveform and the threshold level (step S301), threshold level data for the ink droplet detection signal corresponding to each ink droplet volume and number of ink droplets during normal operation is retrieved from a memory 308 in accordance with a conditions selection signal 402 output by the measurement section conditions specifying device 502. The retrieved data is compared with the ink droplet detection signal received from the waveform A/D converter 204. Thereupon, at step S302, the result of the comparison between the waveform and the threshold level at step S301, and the set conditions of the measurement section conditions specifying device 502 are obtained, and at step S303, the comparison result is compared with the set conditions.

If this step indicates that the comparison result is matching the set conditions (Y verdict), then at step S305, it is judged that the corresponding nozzle or corresponding nozzle region is normal. Furthermore, if the comparison result does not match the set conditions (N verdict), then it is judged at step S304 whether or not only the inspection applies to one nozzle only. If it is judged that the inspection applies to one nozzle (Y verdict), then at step S306, it is judged that the corresponding nozzle requires maintenance. Moreover, if it is judged that the inspection does not apply to one nozzle (N verdict), then at step S307, the corresponding nozzle region is switched to nozzle-by-nozzle determination and this decision is transmitted to the discharge determination method specifying device 501.

Even if the inspection does not apply to one nozzle only in the aforementioned judgment step, provided that there is no impediment to maintenance being carried out for all of the nozzles in the corresponding region, then although not shown in the drawings, it is possible to judge that maintenance is required for that region.

Next, the step of determining ΔS from the waveform at step S210 is described.

In determining ΔS from the waveform, the amount of fall ΔS in the output signal is determined from the ink droplet detection signal output by the waveform A/D converter 204. In step S212, the f(x) data measured for each nozzle is retrieved from the memory 214 on the basis of a condition selection signal 402 output by the measurement section conditions specifying device 502, and using this data and the value for the fall ΔS in the output signal obtained from the waveform at step S210, a value of D is found at step S216, and hence the droplet size is calculated. If the droplet size has been calculated, then the discharge volume can be determined.

Next, the step of determining Δt from the waveform at step S211 is described.

In determining Δt from the waveform, the duration Δt of the fall in the output signal is found from the ink droplet detection signal output by the waveform A/D converter 204.

At step S213, the data relating to W and $\epsilon(W, D)$ as measured for each nozzle is retrieved from the memory 215 on the basis of a conditions selection signal 402 output by the measurement section conditions specifying device 502. Furthermore, the value of V is found by using the following equation (3), $V=(W+D)\times10^{-6}/\Delta t+\epsilon(W, D)$, with respect to the value of D calculated from equation (2), $D=f(\Delta S)$, at step S212, and the value of the fall duration, Δt, in the output signal obtained from the waveform at step S211. Thus, at step S217, the droplet velocity (discharge velocity) is calculated.

As described above, according to the present embodiment, since a light beam for determining ink droplets is formed as a parallel light beam, it is possible to achieve uniform determination conditions for nozzles positioned nearer the light source and nozzles positioned nearer the light sensor, in a long head. Therefore, stable determination (judgment) can be carried out.

Furthermore, since the cross-sectional shape of the light beam in the direction perpendicular to the optical axis of the light beam is elongated in the direction of flight of the ink droplets, then it is possible to capture the whole of a long, thin ink column obtained immediately after ink discharge, within the light beam, and hence determination sensitivity can be improved. Furthermore, if the cross-sectional shape of the parallel light beam in the direction perpendicular to the optical axis of the light beam is elongated in the breadthways direction of the surface on which the nozzles are arranged, then it is possible to detect a plurality of ink droplets simultaneously. Moreover, by enabling switching between these two determination methods, it is possible to switch between an efficient method for simultaneous determination, and an accurate determination method for verifying the determination results.

Furthermore, since the parallel light beam is made to traverse over the ink droplets discharged from the print head, then even in a print head having nozzles arranged in a matrix configuration, it is possible to inspect the whole of the print head by means of a single determination unit.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet determination device for a droplet discharge apparatus, comprising:

a droplet discharge device having a droplet discharge port surface in which droplet discharge ports which discharge liquid droplets are arranged in a staggered matrix in such a manner that each of the rows of the droplet discharge ports in the staggered matrix is substantially parallel with a lengthwise direction of the droplet discharge port surface;

a detection device in which a light source and a single light sensor for the light source are disposed in such a manner that an optical axis of a light beam formed between the light source and the single light sensor is substantially perpendicular to a direction of flight of the droplets discharged from the droplet discharge ports, and the optical axis of the light beam is substantially parallel to the droplet discharge port surface;

an optical system which forms the light beam into substantially parallel light, when the optical axis is viewed from a direction perpendicular to the optical axis, of which a cross-sectional shape in the direction perpendicular to the optical axis of the substantially parallel light is elongated in the direction of flight of the droplets; and a discharge judgment device which judges a discharge status of the droplet according to a detection signal obtained from the detection device when the droplet is discharged into the substantially parallel light, wherein the cross-sectional shape of the substantially parallel light, perpendicular to the optical axis of the substantially, parallel light, has a first beam width in the direction of flight of the droplets and a second beam width in a breadthways direction of the droplet discharge port surface perpendicular to the lengthwise direction, where the first beam width is set to be greater than a maximum droplet length realizable by a droplet after discharge from the droplet discharge port while remaining narrower than a distance between the droplet discharge port surface and a recording sheet onto which the droplet is to be discharged, the second beam width is set to encompass only the droplets discharged from the droplet discharge ports in only one of the rows in the staggered matrix, the first beam width is greater than the second beam width and a ratio of the first beam width to the second beam width is greater than or equal to 2.

2. The droplet determination device as defined in claim 1, wherein the detection device detects droplets which are discharged from the droplet discharge ports into the substantially parallel light, in a region of up to 0.5 mm from the droplet discharge ports.

3. The droplet determination device as defined in claim 1, further comprising a modification device which switches the cross-sectional shape of the substantially parallel light between a first state in which the cross-sectional shape of the substantially parallel light is elongated in the direction of flight of the droplets and a second state in which the cross-sectional shape of the substantially parallel light is elongated in a direction perpendicular to the direction of flight of the droplets.

4. The droplet determination device as defined in claim 1, further comprising a scanning device which makes the substantially parallel light traverse with respect to the droplets discharged from the droplet discharge device, in order to detect the droplets.

5. The droplet determination device as defined in claim 4, wherein the scanning device makes the substantially parallel light traverse so as to determine a position corresponding to a certain range of the droplet discharge ports of the droplet discharge device.

6. The droplet determination device as defined in claim 4, wherein the scanning device makes the substantially parallel light traverse in parallel with the droplet discharge port surface, while keeping the substantially parallel light substantially parallel with one of the lengthwise direction of the droplet discharge port surface and the breadthways direction of the droplet discharge port surface.

7. The droplet determination device as defined in claim 4, wherein the scanning device makes the substantially parallel light traverse in a plane that is perpendicular to the direction of flight of the droplets discharged from the droplet discharge device.

8. The droplet determination device as defined in claim 1, wherein the substantially parallel light is substantially parallel light when the optical axis thereof is viewed from the direction of flight of the droplets, and is one of a converging light and a diverging light when viewed from the breadthways direction of the droplet discharge port surface.

9. The droplet determination device as defined in claim 1, further comprising a discharge timing control device which controls droplet discharge of the droplet discharge device in such a manner that, when the droplet discharge device discharges a plurality of droplets into the substantially parallel light, discharge timings for the droplets are respectively staggered.

10. A droplet determination device for a droplet discharge apparatus, comprising:

a droplet discharge device having droplet discharge ports which discharge liquid droplets;

a detection device in which a light source and a single light sensor for the light source are disposed in such a manner that an optical axis of a light beam formed between the light source and the single light sensor is substantially perpendicular to a direction of flight of the droplets discharged from the droplet discharge ports, and the optical axis of the light beam is substantially parallel to a droplet discharge port surface in which the droplet discharge ports are arranged;

an optical system which forms the light beam into substantially parallel light, when the optical axis is viewed from a direction perpendicular to the optical axis, of which a cross-sectional shape in the direction perpendicular to the optical axis of the light beam is elongated in the direction of flight of the droplets;

a discharge judgment device which judges a discharge status of the droplet according to a detection signal obtained from the detection device when the droplet is discharged into the light beam; and a droplet velocity calculating device which calculates a velocity V m/sec of the discharged droplet by means of the following equation:

$$V=(W+D)\times 10^{-6}/\Delta t+\epsilon(W, D),$$

where a size of the droplet as determined from an amount of fall in the detection signal obtained from the detection device due to the droplet transiting the light beam is taken to be D μm, a width of the light beam in the direction of flight of the droplet is taken to be W μm, a duration of the fall in the detection signal is taken to be Δt sec, and a prescribed error correction value determined with respect to the width of the light beam W and the droplet size D is taken to be ϵ(W, D) m/sec, wherein a width of the light beam is set to be greater than a maximum droplet length realizable by a droplet after discharge from the droplet discharge port while remaining narrower than a distance between the droplet discharge device and a recording sheet onto which the droplet is to be discharged.

11. The droplet determination device as defined in claim 1, wherein the light source of the detection device is any one of: a laser diode, a solid laser, a gas laser, a light-emitting diode, an electro luminescence device, a xenon lamp, a metal halide lamp, a cold cathode fluorescent tube, a hot cathode fluorescent tube, and a halogen lamp.

12. A droplet determination device for a droplet discharge apparatus, comprising:

a droplet discharge device having a droplet discharge port surface in which droplet discharge ports which discharge liquid droplets are arranged in a staggered matrix in such a manner that each of rows of the droplet discharge ports in the staggered matrix is substantially parallel with a lengthwise direction of the droplet discharge port surface;

a detection device in which a light source and a single light sensor for the light source are disposed in such a manner that an optical axis of a light beam formed between the light source and the single light sensor is substantially perpendicular to a direction of flight of the droplets discharged from the droplet discharge ports, and the optical axis of the light beam is substantially parallel to the droplet discharge port surface;

an optical system which forms the light beam into substantially parallel light, when the optical axis is viewed from a direction perpendicular to the optical axis, of which a cross-sectional shape in the direction perpendicular to the optical axis of the substantially parallel light is elongated in a breadthways direction of the droplet discharge port surface, which is perpendicular to the lengthwise direction of the droplet discharge port surface, in such a manner that the substantially parallel light is capable of containing droplets discharged from the discharge ports arranged in the breadthways direction; and a discharge judgment device which judges a discharge status of the droplet according to a detection signal obtained from the detection device when the droplet is discharged into the substantially parallel light, wherein the cross-sectional shape of the substantially parallel light, perpendicular to the optical axis of the substantially parallel light, has a first beam width in the breadthways direction of the droplet discharge port surface and a second beam width in the direction of flight of the droplets, where the first beam width is greater than the second beam width and a ratio of the first beam width to the second beam width is greater than or equal to 2.

13. The droplet determination device as defined in claim 12, wherein the detection device detects droplets which are discharged from the droplet discharge ports into the substantially parallel light, in a region of up to 0.5 mm from the droplet discharge ports.

14. The droplet determination device as defined in claim 12, further comprising a modification device which switches the cross-sectional shape of the substantially parallel light between a first state in which the cross-sectional shape of the substantially parallel light is elongated in the direction of flight of the droplets and a second state in which the cross-sectional shape of the substantially parallel light is elongated in a direction perpendicular to the direction of flight of the droplets.

15. The droplet determination device as defined in claim 12, further comprising a scanning device which makes the substantially parallel light traverse with respect to the droplets discharged from the droplet discharge device, in order to detect the droplets.

16. The droplet determination device as defined in claim 15, wherein the scanning device makes the substantially parallel light traverse so as to determine a position corresponding to a certain range of the droplet discharge ports of the droplet discharge device.

17. The droplet determination device as defined in claim 15, wherein the scanning device makes the substantially parallel light traverse in parallel with the droplet discharge port surface, while keeping the substantially parallel light substantially parallel with one of the lengthwise direction of the droplet discharge port surface and the breadthways direction of the droplet discharge port surface.

18. The droplet determination device as defined in claim 15, wherein the scanning device makes the substantially parallel light traverse in a plane that is perpendicular to the direction of flight of the droplets discharged from the droplet discharge device.

19. The droplet determination device as defined in claim 12, wherein the substantially parallel light is substantially parallel light when the optical axis thereof is viewed from the direction of flight of the droplets, and is one of a converging light and a diverging light when viewed from the breadthways direction of the droplet discharge port surface.

20. The droplet determination device as defined in claim 12, further comprising a discharge timing control device which controls droplet discharge of the droplet discharge device in such a manner that, when the droplet discharge device discharges a plurality of droplets into the substantially parallel light, discharge timings for the droplets are respectively staggered.

21. A droplet determination device for a droplet discharge apparatus, comprising:

a droplet discharge device having droplet discharge ports which discharge liquid droplets;

a detection device in which a light source and a single light sensor for the light source are disposed in such a manner tat an optical axis of a light beam formed between the light source and the single light sensor is substantially perpendicular to a direction of flight of the droplets discharged from the droplet discharge ports, and the optical axis of the light beam is substantially parallel to a droplet discharge port surface in which the droplet discharge ports are arranged;

an optical system which forms the light beam into substantially parallel light, when the optical axis is viewed from a direction perpendicular to the optical axis, of which a cross-sectional shape in the direction perpendicular to the optical axis of the light beam is elongated in a breadthways direction of the droplet discharge port surface, which is perpendicular to a lengthwise direction of the droplet discharge port surface, in such a manner tat the light beam is capable of containing droplets discharged from the discharge ports arranged in the breadthways direction;

a discharge judgment device which judges a discharge status of the droplet according to a detection signal obtained from the detection device when the droplet is discharged into the light beam; and a droplet velocity calculating device which calculates a velocity V m/sec of the discharged droplet by means of the following equation:

$$V=(W+D)\times 10^{-6}/\Delta t+\epsilon(W, D),$$

where a size of the droplet as determined from an amount of fall in the detection signal obtained from the detection device due to the droplet transiting the light beam is taken to be D μm, a width of the light beam in the direction of flight of the droplet is taken to be W μm, a duration of the fall in the detection signal is taken to be Δt sec, and a prescribed error correction value determined with respect to the width of the light beam W and the droplet size D is taken to be ϵ(W, D) m/sec, wherein a width of the light beam is set to be greater than a maximum droplet length realizable by a droplet after discharge from the droplet discharge port while remaining narrower than a distance between the droplet discharge device and a recording sheet onto which the droplet is to be discharged.

22. The droplet determination device as defined in claim 12, wherein the light source of the detection device is any one of: a laser diode, a solid laser, a gas laser, a light-emitting diode, an electro luminescence device, a xenon lamp, a metal halide lamp, a cold cathode fluorescent tube, a hot cathode fluorescent tube, and a halogen lamp.

23. A droplet determination method for determining droplets discharged by a droplet discharge apparatus, comprising the steps of:

forming a light beam between a light source and a single light sensor for the light source, an optical axis of the light beam being substantially parallel to a lengthwise direction of a droplet discharge port surface of the droplet discharge apparatus in which droplet discharge ports are arranged in a staggered matrix in such a manner that each of rows of the droplet discharge ports in the staggered matrix is substantially parallel with the lengthwise direction of the droplet discharge port surface, the light beam being substantially parallel light when the optical axis is viewed from at least one direction in a plane perpendicular to the light beam, and being formed with a cross-sectional shape perpendicular to the optical axis that is elongated in a direction of flight of the discharged droplets; and judging a discharge status of a droplet according to a detection signal obtained by the single light sensor when the droplet is discharged into the substantially parallel light in such a manner that the direction of flight of the droplet is substantially perpendicular to the optical axis of the light beam, wherein the cross-sectional shape of the substantially parallel light, perpendicular to the optical axis of the substantially parallel light, has a first beam width in the direction of flight of the droplets and a second beam width in a breadthways direction of the droplet discharge port surface perpendicular to the lengthwise direction, where the first beam width is set to be greater than a maximum droplet length realizable by a droplet after discharge from the droplet discharge port while remaining narrower than a distance between the droplet discharge port surface and a recording sheet onto which the droplet is to be discharged, the second beam width is set to encompass only the droplets discharged from the droplet discharge ports in only one of the rows in the staggered matrix, the first beam width is greater than the second beam width and a ratio of the first beam width to the second beam width is greater than or equal to 2.

24. A droplet determination method for determining droplets discharged by a droplet discharge apparatus, comprising the steps of:

forming a light beam between a light source and a single light sensor for the light source, an optical axis of the light beam being substantially parallel to a lengthwise direction of a droplet discharge port surface of the droplet discharge apparatus in which droplet discharge ports are arranged in a staggered matrix in such a manner that each of rows of the droplet discharge ports in the staggered matrix is substantially parallel with the lengthwise direction of the droplet discharge port surface, the light beam being substantially parallel light when the optical axis is viewed from at least one direction in a plane perpendicular to the light beam, and being formed with a cross-sectional shape perpendicular to the optical axis that is elongated in a breadthways direction of the droplet discharge port surface which is perpendicular to the lengthwise direction of the droplet discharge port surface, in such a manner that the substantially parallel light is capable of containing droplets discharged from the droplet discharge ports arranged in the breadthways direction; and judging a discharge status of the droplet according to a detection signal obtained by the single light sensor when the droplet is discharged into the substantially parallel light in such a manner that a direction of flight of the droplet is substantially perpendicular to the optical axis of the substantially parallel light, wherein the cross-sectional shape of the substantially parallel light, perpendicular to the optical axis of the substantially parallel light, has a first beam width in the breadthways direction of the droplet discharge port surface and a second beam width in the direction of flight of the droplets, where the first beam width is greater than the second beam width and a ratio of the first beam width to the second beam width is greater than or equal to 2.

25. A droplet determination method for determining droplets discharged by a droplet discharge apparatus, comprising the steps of:

forming a first light beam between a light source and a single light sensor for the light source, an optical axis of the first light beam being substantially parallel to a lengthwise direction of a droplet discharge port surface of the droplet discharge apparatus in which droplet discharge ports are arranged in a staggered matrix in such a manner that each of rows of the droplet discharge ports in the staggered matrix is substantially parallel with the lengthwise direction of the droplet discharge port surface, the first light beam being substantially parallel first light when the optical axis of the first light beam is viewed from at least one direction in a plane perpendicular to the first light beam, and being formed with a cross-sectional shape perpendicular to the optical axis of the first light beam that is elongated in a breadthways direction of the droplet discharge port surface which is perpendicular to the lengthwise direction of the droplet discharge port surface, in such a manner that the substantially parallel first light is capable of containing droplets discharged from the droplet discharge ports arranged in the breadthways direction;

detecting a plurality of droplets simultaneously according to detection signals obtained by the single light sensor when droplets are discharged into the substantially parallel first light in such a manner that a direction of flight of the droplets is substantially perpendicular to the optical axis of the substantially parallel first light;

if there is a droplet discharge port with possibility of discharge failure, forming a second light beam between the light source and the single light sensor, an optical axis of the second light beam being substantially parallel to the lengthwise direction of the droplet discharge port surface, the second light beam being substantially parallel second light when the optical axis of the second light beam is viewed from at least one direction of the plane perpendicular to the second light beam, and being formed with a cross-sectional shape perpendicular to the optical axis of the second light beam that is elongated in the direction of flight of the discharged droplets; and judging a discharge status of droplets according to a detection signal obtained by the single light sensor when the droplets are discharged into the substantially parallel second light in such a manner that the direction of flight of the droplets is substantially perpendicular to the optical axis of the substantially parallel second light, wherein the cross-sectional shape of the substantially parallel second light, perpendicular to the optical axis of the substantially parallel second light, has a first beam width in the direction of flight of the droplets and a second beam width in the breadthwavs direction of the droplet discharge port surface, where the first beam width is set to be greater than a maximum droplet length realizable by a droplet after discharge from the droplet discharge port while remaining narrower than a distance between the droplet discharge port surface and a recording sheet onto which the droplet is to be discharged, the second light beam width is set to encompass only the droplets discharged from the droplet discharge ports in only one of the rows in the staggered matrix, the first beam width is greater than the second beam width and a ratio of the first beam width to the second beam width is greater than or equal to 2.

* * * * *